US005353756A

United States Patent [19]

Murata et al.

[11] Patent Number: 5,353,756

[45] Date of Patent: Oct. 11, 1994

[54] VALVE OPERATING SYSTEM STRUCTURE WITH VARIABLE VALVE TIMING MECHANISM

[75] Inventors: Shinichi Murata; Noriyuki Miyamura, both of Kyoto; Hirofumi Higashi, Kameoka; Masahiko Kubo, Kyoto, all of Japan

[73] Assignee: Mitsubishi Jidosha Kogyo Kabushiki Kaisha, Tokyo, Japan

[21] Appl. No.: 92,439

[22] Filed: Jul. 14, 1993

[30] Foreign Application Priority Data

| | | | |
|---|---|---|---|
| Jul. 16, 1992 | [JP] | Japan | 4-189760 |
| Jul. 16, 1992 | [JP] | Japan | 4-189761 |
| Jul. 16, 1992 | [JP] | Japan | 4-189762 |
| Jul. 17, 1992 | [JP] | Japan | 4-189789 |
| Jul. 17, 1992 | [JP] | Japan | 4-189792 |
| Jul. 17, 1992 | [JP] | Japan | 4-191099 |

[51] Int. Cl.[5] ..... F01L 1/34; F01L 1/32; F01L 1/24

[52] U.S. Cl. ..... 123/90.16; 123/90.28; 123/90.46

[58] Field of Search ..... 123/90.15, 90.16, 90.17, 123/90.22, 90.28, 90.39, 90.4, 90.45, 90.46

[56] References Cited

U.S. PATENT DOCUMENTS

| | | | |
|---|---|---|---|
| 4,805,567 | 2/1989 | Heimburg | 123/90.28 |
| 4,903,651 | 2/1990 | Matsuura et al. | 123/90.46 |
| 4,913,105 | 4/1990 | Kawasaki | 123/90.46 |
| 5,046,462 | 9/1991 | Matayoshi et al. | 123/90.16 |
| 5,080,054 | 1/1992 | Nakamura | 123/90.16 |
| 5,099,806 | 3/1992 | Murata et al. | 123/90.16 |
| 5,099,812 | 3/1992 | Yamada | 123/90.28 |

FOREIGN PATENT DOCUMENTS

| | | | |
|---|---|---|---|
| 0949852 | 10/1951 | Fed. Rep. of Germany . | |
| 2817485 | 10/1979 | Fed. Rep. of Germany ... | 123/90.28 |
| 1275328 | 5/1972 | United Kingdom . | |

OTHER PUBLICATIONS

Patent Abstract of Japan, Kamimaru Shinji et al., Variable Valve Timing Type Valve System; Pub. date Sep. 30, 1991; Publication No.: JP3156114; Jul. 4, 1991.

*Primary Examiner*—E. Rollins Cross
*Assistant Examiner*—Weilun Lo

[57] ABSTRACT

The valve operating system structure with a variable valve timing mechanism of the invention comprises an intake valve or an exhaust valve provided for an engine, a low speed cam having a cam profile for a low speed valve timing and rotatable in response to rotation of a crankshaft of the engine, a high speed cam having a cam profile for a high speed valve timing and rotatable in response to rotation of the crankshaft, a main rocker arm for contacting with the low speed cam so as to be operated by the low speed cam, a sub rocker arm for contacting with the high speed cam so as to be operated by the high speed cam, mode change-over means for changing over the mode of the sub rocker arm between a non-interlocking mode in which the sub rocker arm is not interlocked with the main rocker arm and an interlocking mode in which the sub rocker arm is interlocked with the main rocker arm, a swing arm supported for pivotal motion and for adjustment in phase relative to the main rocker arm and having a valve contacting portion for contacting with the valve to drive the valve, and a hydraulic lash adjuster for adjusting the relative phase between the main rocker arm and the swing arm.

20 Claims, 21 Drawing Sheets

VALVE OPERATING SYSTEM STRUCTURE WITH VARIABLE VALVE TIMING MECHANISM

BACKGROUND OF THE INVENTION

1) Field of the Invention

This invention relates to a valve operating system for driving an intake valve or an exhaust valve provided for an engine to open or close in response to rotation of a crankshaft, and more particularly to a valve operating system structure with a variable valve timing mechanism which can change over the operation timing of such valve between a low speed operation and a high speed operation.

2) Description of the Related Art

In recent years, as the automobile society has matured, the requirement for an engine has become progressively higher and is diversified, and much effort has been directed, in addition to the performance of an engine, to reduction of vibrations and noise and to a maintenance-free feature.

For example, an apparatus for an OHC (overhead camshaft) engine for use with an automobile or a like vehicle has been developed wherein a valve operating system for operating an intake valve or an exhaust valve is operated to vary the operating timing of the intake or exhaust valve in order to enhance the performance of the engine.

In the apparatus of the type described above (that is, variable valve timing mechanism), for example, a cam for a high speed and another cam for a low speed are provided on a camshaft and selectively used to obtain an operation timing of the intake or exhaust valve in accordance with an operating condition of the engine.

The high speed cam has a cam profile which can provide an operation timing suitable for high speed operation, and the low speed cam has another cam profile which can provide another operation timing suitable for low speed operation.

In a cam apparatus of the rocker arm type, the selection mechanism between the high speed cam and the low speed cam is constructed such that a pair of rocker arms are selectively connected to or disconnected from each other so that the valve is operated alternatively by the high speed cam or the low speed cam in order to obtain an operation timing of the intake or exhaust valve in accordance with an operation condition of the engine.

In order to allow adjustment of the clearance between a rocker arm and a valve, generally an adjust screw (tappet screw) is provided at a valve contacting portion of the rocker arm at which the rocker arm contacts with the valve.

However, where such adjust screw is employed, a gap may possibly be produced between the adjust screw and an opposing end of the stem of the valve, and if such gap exists, then when the valve is operated by rocking motion of the rocker arm, the adjust screw hits the end of the valve stem to produce an impact sound. Particularly with a valve operating system with a variable valve timing mechanism, if the adjustment of the clearances between rocker arms and valves is not performed appropriately, when it is tried to connect the rocker arms to each other, a required movement may be obstructed to obstruct smooth adjustment of the valve timing.

In order to eliminate this, the clearance between the rocker arm and the valve must always be controlled to adjust the position of the adjust screw in accordance with the degree of abrasion at the end of the adjust screw and so forth.

In order to achieve reduction of vibrations and noise and a maintenance-free feature of a valve operating system with a variable valve timing mechanism, a valve operating apparatus has been proposed in Japanese Patent Laid-Open Application No. Showa 61-81510. In the valve operating apparatus, a hydraulic lash adjuster (HLA) is incorporated in a valve contacting portion of a rocker arm in place of an adjust screw so that the clearance between the rocker arm and the valve may be adjusted automatically.

In the valve operating mechanism, however, since the hydraulic lash adjuster is disposed at the valve contacting portion of the rocker arm, the valve side conversion weight of the valve operating mechanism is increased, which deteriorates the operating characteristic of the valve so that the valve may possibly not operate in a designed manner.

Consequently, the valve operating mechanism has a subject particularly with regard to output power of the engine during high speed rotation and durability of the engine.

Further, since the valve contacting portion of the rocker arm is spaced away from the center of rocking motion of the rocker arm, also the hydraulic lash adjuster located at the valve contacting portion is spaced away from the center of rocking motion of the rocker arm. This leads to the following drawbacks.

In short, particularly during high speed rotation of the engine the hydraulic lash adjuster is acted upon by an acceleration and a centrifugal force caused by rocking motion of the rocker arm so that a check valve ball built into it is liable to rage, and consequently, oil in a high pressure chamber in the hydraulic lash adjuster may flow out to increase the valve lift loss. Accordingly, the subject with regard to the output power and the durability of the engine becomes progressively important.

Naturally, when it is tried to solve the subject, a possible increase of the size and/or the weight of the valve operating system is desired to be suppressed as small as possible.

Thus, it seems a promising idea to provide, separately from a rocker arm, an arm (swing arm) which can be adjusted in phase with respect to the rocker arm such that the swing arm is contacted with a valve and a hydraulic lash adjuster is interposed between the rocker arm and the swing arm such that it can automatically adjust the relative phase between the rocker arm and the swing arm.

In this instance, however, since the valve operating system includes an increased number of components, the following subjects are produced depending upon the arrangement of the components:

1. Where a cam for a low speed and another cam for a high speed are disposed at a comparatively short distance, when the cams are to be cast together with the cam shaft, the mold drawability is deteriorated.

2. Where the low speed cam and the high speed cam are disposed at a comparatively short distance, when the low speed cam is to be polished, the grind stone may possibly interfere with the high speed cam which projects rather than the low speed cam.

3. Where the valve operating system is, for example, of the two valve type, the overall width of the valve operating system may be increased, resulting in decrease of the degree of freedom in designing.

4. Upon high speed operation, a lift of the high speed cam is transmitted from the rocker arm for a high speed (sub rocker arm) to the rocker shaft by way of a piston (plunger) and then transmitted from the rocker arm for a low speed (main rocker arm) to the valve by way of the swing arm. Upon such transmission of power, the rocker shaft undergoes torsion, which is a cause of deterioration of the rigidity of the entire valve operating system.

Further, where a hydraulic lash adjuster is employed for a valve operating system as described above, this has a significant influence upon the motion characteristic of the valve operating system.

On one hand, the rigidity of the entire valve system is deteriorated since the high pressure of oil in a high pressure chamber acts upon the valve system. As a countermeasure for this, enhancement of the rigidity of the high pressure chamber is required by increasing the diameter of the plunger and decreasing the volume of the high pressure chamber. In this instance, however, the diameter of the plunger has a higher influence.

On the other hand, although depending upon the type of the valve operating system, the valve side conversion weight is increased by attachment of the hydraulic lash adjuster.

Further, since the inertial weight around the valve and the valve spring force act directly upon the hydraulic lash adjuster, the hydraulic lash adjuster must necessarily have a correspondingly high rigidity.

Thus, if the diameter of the plunger of the hydraulic lash adjuster is increased in order to enhance the rigidity of the high pressure chamber, then this results in an increase of the weight of the hydraulic lash adjuster and deterioration of the motion characteristic of the valve. Consequently, the subject described above becomes further significant.

Therefore, it is desired to reduce the inertial weight around the valve and the valve spring force which act upon the hydraulic lash adjuster by some means.

Meanwhile, in a valve operating system with a variable valve timing mechanism, it is desired to keep the valve clearance at an appropriate value. Particularly, the end of the stem of the valve and the contacting portion of the rocker arm with the end of the stem of the valve are liable to be abraded, and such abrasion may obstruct appropriate operation of the variable valve timing mechanism.

Particularly where the hydraulic lash adjuster is incorporated in the valve operating system as in the valve operating apparatus disclosed in Japanese Patent Laid-Open Application No. Showa 61-81510 mentioned above, the load to the valve operating system is increased, and there is a subject that the abrasion at the contacting portion described above is liable to increase.

SUMMARY OF THE INVENTION

It is an object of the present invention to provide a valve operating system with a variable valve timing mechanism which realizes reduction of vibrations and noise and a maintenance-free feature.

It is another object of the present invention to provide a valve operating system with a variable valve timing mechanism which has a structure which allows the valve operating system to be produced readily.

It is a further object of the present invention to provide a valve operating system with a variable valve timing mechanism which can be reduced in size and weight while assuring a sufficient rigidity.

It is a still further object of the present invention to provide a valve operating system with a variable valve timing mechanism wherein the load to a hydraulic lash adjuster employed is reduced and the lash adjuster can be reduced in weight.

It is a yet further object of the present invention to provide a valve operating system with a variable valve timing mechanism wherein abrasion by contact between members is reduced and the valve clearance is always kept appropriately.

In order to attain the objects described above, according to an aspect of the present invention, there is provided a valve operating system structure with a variable valve timing mechanism, which comprises an intake valve or an exhaust valve provided for an engine, a low speed cam having a cam profile for a low speed valve timing and rotatable in response to rotation of a crankshaft of the engine, a high speed cam having a cam profile for a high speed valve timing and rotatable in response to rotation of the crankshaft, a main rocker arm for contacting with the low speed cam so as to be operated by the low speed cam, a sub rocker arm for contacting with the high speed cam so as to be operated by the high speed cam, mode change-over means for changing over the mode of the sub rocker arm between a non-interlocking mode in which the sub rocker arm is not interlocked with the main rocker arm and an interlocking mode in which the sub rocker arm is interlocked with the main rocker arm, a swing arm supported for pivotal motion and for adjustment in phase relative to the main rocker arm and having a valve contacting portion for contacting with the valve to drive the valve, and a hydraulic lash adjuster for adjusting the relative phase between the main rocker arm and the swing arm.

Preferably, the hydraulic lash adjuster is disposed at a location nearer to the center of rocking motion of the main rocker arm than to the valve contacting portion of the swing arm. In this instance, preferably, the hydraulic lash adjuster is disposed such that it projects from an upper face of the main rocker arm. Preferably, the swing arm is disposed such that the center of rocking motion thereof is displaced toward the valve contacting portion thereof from the center of rocking motion of the main rocker arm, and the hydraulic lash adjuster is disposed adjacent the center of rocking motion of the main rocker arm with respect to the center of rocking motion of the swing arm while the valve contacting portion of the swing arm is disposed on the opposite side to the hydraulic lash adjuster with respect to the center of rocking motion of the swing arm. The main rocker arm may have a low speed roller provided thereon for contacting with the low speed cam while the sub rocker arm has a high speed roller provided thereon for contacting with the high speed cam. Preferably, the hydraulic lash adjuster is disposed at or around the center of rocking motion of the main rocker arm, and preferably, the main rocker arm is supported on a rocker shaft in which an operating liquid supply passage for supplying operating liquid to the hydraulic lash adjuster therethrough is formed. The mode change-over means may include a hydraulic piston mechanism movable between a position in which the sub rocker arm is operatively independent of the main rocker arm and another position in which the sub rocker arm is capable of being interlocked with the main rocker arm, and the hydraulic piston mechanism may be disposed on a rocker shaft on which the main rocker arm is supported for pivotal motion.

Preferably, the swing arm and the hydraulic lash adjuster are disposed between the main rocker arm and the sub rocker arm.

Preferably, the main rocker arm has a low speed roller provided thereon for contacting with the low speed cam while the sub rocker arm has a high speed roller provided thereon for contacting with the high speed cam, and the low speed roller and the swing arm are supported in a coaxial relationship with each other.

Preferably, the main rocker arm is supported on a rocker shaft in which an operating liquid supply passage for supplying operating liquid to the hydraulic lash adjuster therethrough is formed, and the distance from the center of rocking motion of the main rocker arm to the hydraulic lash adjuster is set smaller than the sum of the radius of the operating liquid supply passage and the radius of the hydraulic lash adjuster.

Preferably, the swing arm is disposed such that the center of rocking motion thereof is displaced toward the valve contacting portion thereof from the center of rocking motion of the main rocker arm, and the hydraulic lash adjuster is disposed at an end portion of the main rocker arm adjacent the center of rocking motion of the main rocker arm with respect to the center of rocking motion of the swing arm while the valve contacting portion of the swing arm is disposed at the opposite end of the main rocker arm to the hydraulic lash adjuster with respect to the center of rocking motion of the swing arm such that the distance from the hydraulic lash adjuster to the center of rocking motion of the swing arm is set greater than the distance from the valve contacting portion of the swing arm to the center of rocking motion of the swing arm.

The center of contact of the valve contacting portion of the swing arm with the valve may be located at a position displaced from the axis of the valve. In this instance, preferably the valve is provided as a pair of valves and the swing arm is bifurcated into a pair of branches each having the valve contacting portion at an end thereof, and the centers of contact of the valve contacting portions with the valves are located at positions displaced from the axes of the valves. Further preferably, the centers of contact of the valve contacting portions with the valves are located at positions displaced inwardly toward each other with respect to the axes of the valves. An interposed member may be interposed between the valve contacting portion of the swing arm and the valve.

According to another aspect of the present invention, there is provided a valve operating system structure with a variable valve timing mechanism, which comprises an intake valve or an exhaust valve provided for an engine, a low speed cam having a cam profile for a low speed valve timing and rotatable in response to rotation of a crankshaft of the engine, a high speed cam having a cam profile for a high speed valve timing and rotatable in response to rotation of the crankshaft, a main rocker arm for contacting with the low speed cam so as to be operated by the low speed cam to operate the valve, a sub rocker arm for contacting with the high speed cam so as to be operated by the high speed cam, and mode change-over means for changing over the mode of the sub rocker arm between a non-interlocking mode in which the sub rocker arm is not interlocked with the main rocker arm and an interlocking mode in which the sub rocker arm is interlocked with the main rocker arm, the main rocker arm having a valve contacting portion for contacting with the valve to drive the valve, the center of contact of the valve contacting portion of the main rocker arm being located at a position displaced from the axis of the valve.

The valve operating system structure with a variable valve timing mechanism may be constructed such that the valve is provided as a pair of valves and the main rocker arm is bifurcated into a pair of branches each having the valve contacting portion at an end thereof, and the centers of contact of the valve contacting portions with the valves are located at positions displaced from the axes of the valves. In this instance, preferably, the centers of contact of the valve contacting portions with the valves are located at positions displaced inwardly toward each other with respect to the axes of the valves.

An interposed member may be interposed between each of the valve contacting portions of the main rocker arm and the corresponding valve.

DETAILED DESCRIPTION OF THE INVENTION AND THE PREFERRED EMBODIMENTS

Figure 1:
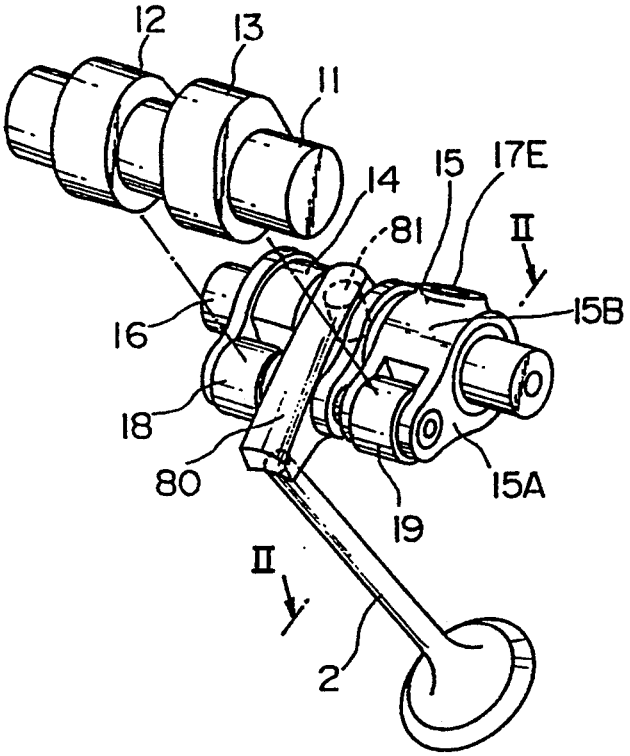
FIG. 1 is a schematic perspective view showing part of a valve operating system structure with a variable valve timing mechanism according to a first preferred embodiment of the present invention.

Referring first to FIG. 1, there is shown a valve operating system structure with a variable valve timing mechanism according to a first preferred embodiment of the present invention. The valve operating system shown is provided for a single valve which may be an intake valve or an exhaust valve, and is constructed so as to operate the valve 2 to open or close.

The valve operating system includes a pair of cams 12 and 13 which rotate upon rotation of a crankshaft (not shown) of an engine (not shown), and a pair of rocker arms 14 and 15 which are operated by the cams 12 and 13, respectively.

Figure 10:
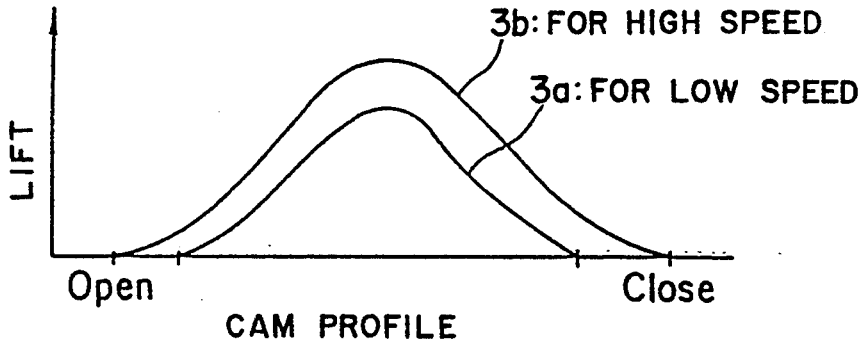
FIG. 10 is a diagram showing cam profiles of the valve operating system structure with a variable valve timing mechanism shown in FIG. 1.

The cams 12 and 13 are mounted on a camshaft 11 which rotates by rotation of the crankshaft of the engine, and the cam 12 serves as a cam for a low speed having a cam profile for a valve timing upon rotation of the engine at a low speed while the cam 13 serves as another cam for a high speed having a cam profile for a valve timing upon rotation of the engine at a high speed. The cams 12 and 13 have an equal base circle diameter and have such cam profiles as shown in FIG. 10. As seen from FIG. 10, the cam profile 3*b* of the high speed cam 13 is set so as to include the cam profile 3*a* of the low speed cam 12.

The rocker arms 14 and 15 are each in the form of a rocker arm with a roller, and the rocker arm 14 serves as a main rocker arm and is contacted by way of a swing arm 80 with the valve 2 to operate the valve 2 to open or close. Meanwhile, the other rocker arm 15 is contacted by way of the main rocker arm 14 with the valve 2 to operate the valve 2 to open or close.

Figure 2:
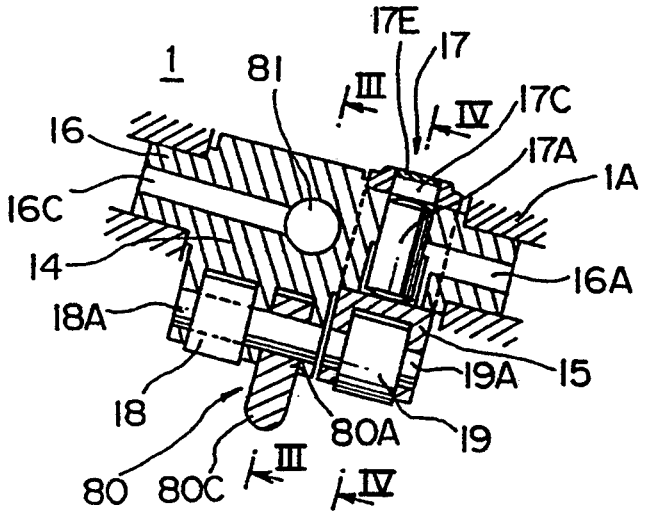
FIG. 2 is a schematic sectional view taken along line II—II of FIG. 1.

Referring to FIG. 2, the main rocker arm 14 has a rocker shaft 16 formed integrally thereon. The rocker shaft 16 is supported for rotation at a bearing portion 1A provided on a cylinder head 1 or a like element of the engine so that the main rocker arm 14 can be pivoted around the axis of the rocker shaft 16.

Referring to FIGS. 1 and 2, a roller 18 for a low speed is mounted at an intermediate portion of the main rocker arm 14 for engaging the low speed cam 12. The low speed roller 18 is supported for smooth rotation by means of a roller bearing (not shown) on a shaft 18A supported for rotation at an intermediate portion of the main rocker arm 14. The shaft 18A serves also as a swing arm shaft.

A swing arm 80 is supported for rocking motion on the main rocker arm 14. In particular, the swing arm 80 is supported at an intermediate portion thereof for pivotal motion on the shaft 18A for the low speed roller 18. A valve contacting portion 80C for contacting with an end portion of a stem 6 of the valve 2 is provided at a free OF rocking end 80A of the swing arm 80.

A hydraulic lash adjuster (HLA) 81 is provided at the other end of the swing arm 80 such that it can adjust the relative phase between the swing arm 80 and the main rocker arm 14.

Figure 3:
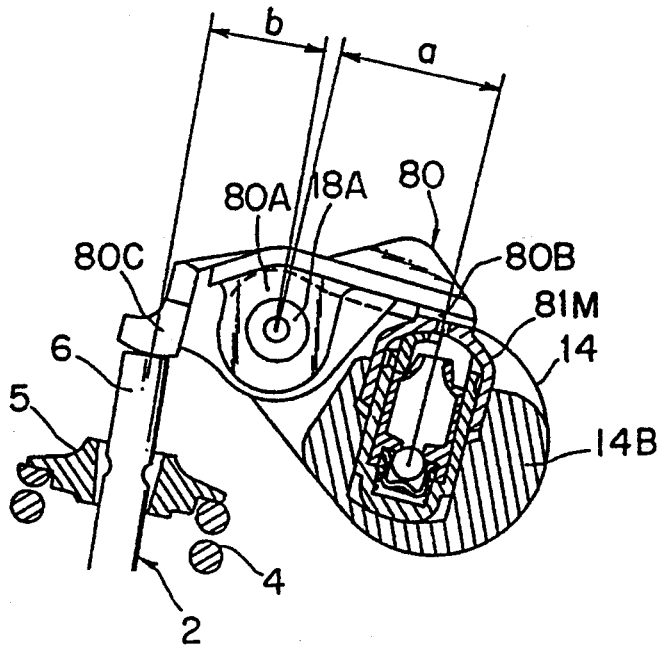
FIG. 3 is a sectional view taken along line III—III of FIG. 2 showing a hydraulic lash adjuster mounted in the valve operating system structure with a variable valve timing mechanism.

Referring to FIG. 3, the hydraulic lash adjuster 81 is positioned such that the distance a between the axis thereof and the axis of rocking motion of the swing arm 80, that is, the axis of the swing arm shaft 18A, is greater than the distance b between the axis of rocking motion of the swing arm 80 and the axis of the valve 2, that is, $a>b$.

Figure 9:
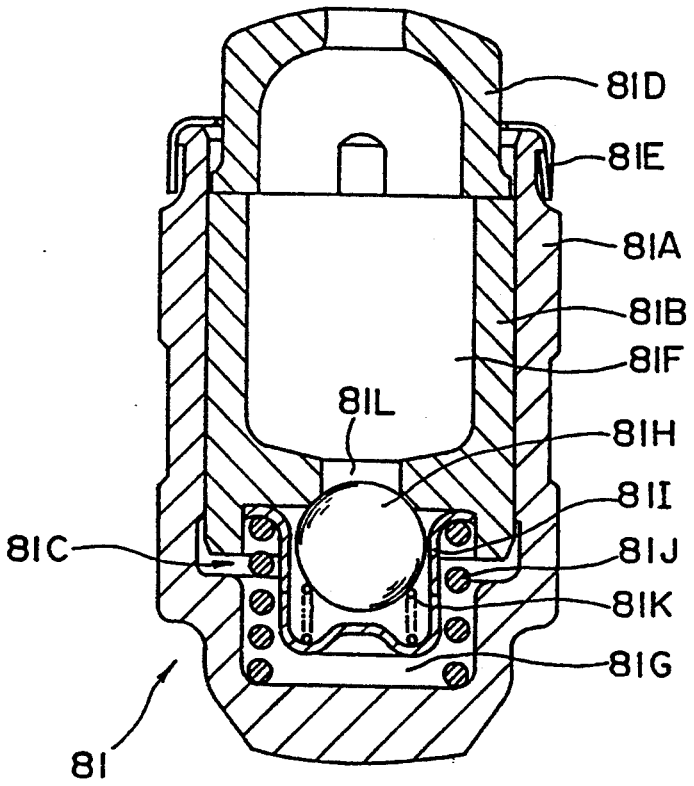
FIG. 9 is a schematic vertical sectional view showing the hydraulic lash adjuster shown in FIG. 3.

Referring to FIG. 9, the hydraulic lash adjuster 81 includes a plunger 81B built in a body 81A thereof. A high pressure chamber 81G is defined between the plunger 81B and the body 81A, and a spring 81J is interposed in the high pressure chamber 81G and biases the plunger 81B in a direction (upward direction in FIG. 9) to move away from the body 81A.

A plunger cap 81D is disposed in contact with an end of the plunger 81B such that the length of the axis of the hydraulic lash adjuster 81 from the lower end of the body 81A to the end of the plunger cap 81D may be increased by the biasing force of the spring 81J. It is to be noted that the plunger cap 81D is retained on a plunger cap retainer 81E so that it cannot be removed from the body 81A.

A reservoir chamber 81F is formed in the inside of the plunger 81B, and operating oil serving as operating fluid is supplied into the reservoir chamber 81F by way of an oil passage or operating liquid supply passage 16C shown in FIG. 2. A hole 81L is perforated in the bottom wall of the reservoir chamber 81F, that is, the lower end of the plunger 81B, and communicates with the high pressure chamber 81G.

A check valve mechanism 81C is provided for closing the hole 81L. The check valve mechanism 81C includes a check valve retainer 81I and a check valve ball 81H accommodated in the check valve retainer 81I. The check valve ball 81H is biased by a check valve spring 81K into contact with the edge of the hole 81L to close the hole 81L.

In the check valve mechanism 81C, when operating oil is supplied into the reservoir chamber 81F to raise the internal pressure, the check valve ball 81H is moved against the check valve spring 81K to open the hole 81L so that the operating oil is supplied into and thereafter held in the high pressure chamber 81G. Accordingly, when the length of the axis of the hydraulic lash adjuster 81 is increased by the biasing force of the spring 81J, the pressure of the operating oil in the reservoir chamber 81F rises so that the operating oil is supplied into the high pressure chamber 81G by way of the check valve mechanism 81C to maintain the oil pressure in the high pressure chamber 81G.

The hydraulic lash adjuster 81 of such a construction as described above is disposed on one of a pair of members for which the clearance between them is to be adjusted such that either the body 81A side is implanted fixedly while the plunger cap 81D side is movable or the plunger cap 81D side is implanted fixedly while the body 81A side is movable, and either an end portion of the plunger cap 81D or a base end portion of the body 81A which is a movable member is contacted with the other member.

Referring back to FIG. 3, in the valve operating system of the present embodiment, the hydraulic lash adjuster 81 is installed such that the body 81A side is fixedly implanted in a base portion 14B of the main rocker arm 14 adjacent the rocker shaft 16 while the plunger cap 81D side is left movable. The rocker shaft side base portion 14B of the main rocker arm 14 is positioned such that it is held between the body of the main rocker arm 14 and the sub rocker arm 15, and has an installation hole for the hydraulic lash adjuster 81 formed at a portion thereof a little depressed with respect to the rocker arms 14 and 15 on the opposite sides of it. The hydraulic lash adjuster 81 is mounted in an upwardly directed posture (with the cap 81D directed upwardly) in the installation hole at the rocker shaft side base portion 14B.

A cover 81M is mounted for movement on the main rocker arm 14 adjacent the plunger cap 81D. The plunger cap 81D contacts with the lower face of the swing arm 80 with the cover 81M interposed therebetween. The oil passage 16C for supplying operating oil into the hydraulic lash adjuster 81 therethrough is formed at a portion of the rocker shaft 16 along the axis.

Accordingly, if the relative phase between the swing arm 80 and the main rocker arm 14 varies to increase the clearance between the corresponding portions of them, then the plunger gap 81D and the cover 81M are projected outwardly, that is, upwardly in FIG. 3, by the biasing force of the spring 81J to increase the axial length of the hydraulic lash adjuster 81 while adjusting the clearance between the swing arm 80 and main rocker arm 14 and the valve 2 and consequently the valve clearance between the rocker arm 14 and the valve 2 by way of the swing arm 80.

In this instance, the oil pressure in the high pressure chamber 81G is maintained by way of the check valve mechanism 81C, and also after adjustment of the clearance, the swing arm 80 and the main rocker arm 14 are kept in a predetermined pressing condition between them so that the valve clearance is maintained stably.

It is to be noted that, in the present structure, the hydraulic lash adjuster 81 is disposed on the center of rocking motion of the main rocker arm 14, that is, the center of the rocker shaft 16, and since the distance H (FIG. 15) from the center of rocking motion of the main rocker arm 14 to the axial line of the hydraulic lash adjuster 81 is very small, naturally the distance H is set so that it may be smaller than the sum of the radius ($=d/2$) of the oil passage 16C and the radius ($=D/2$) of the hydraulic lash adjuster 81, that is, $d/2+D/2$. Hence, $H<d/2+D/2$.

Figure 15:
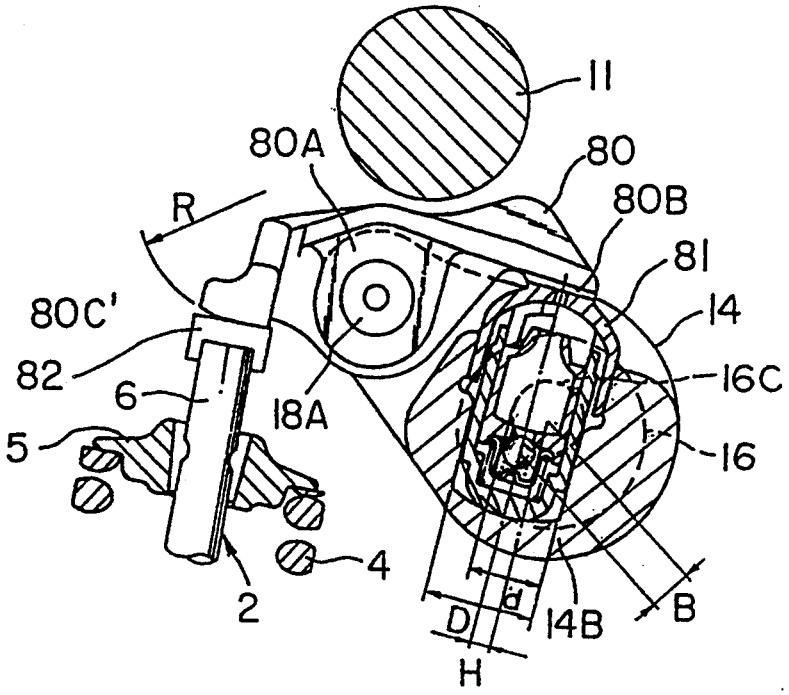
FIG. 15 is a sectional view showing an arrangement of the hydraulic lash adjuster system of the valve operating system structure with a variable valve timing mechanism shown in FIG. 1.

However, in the present structure, the hydraulic lash adjuster 81 need not necessarily be disposed accurately on the center of rocking motion of the main rocker arm 14, and it is only required to set the distance H from the center of rocking motion of the main rocker arm 14 to the axial line of the hydraulic lash adjuster 81 smaller than the gum ($d/2+D/2$) of the radius ($=d/2$) of the oil, passage 16C and the radius $D/2$) of the hydraulic lash adjuster 81, that is, $H<d/2+D/2$, as seen from FIG. 15.

Figure 4:
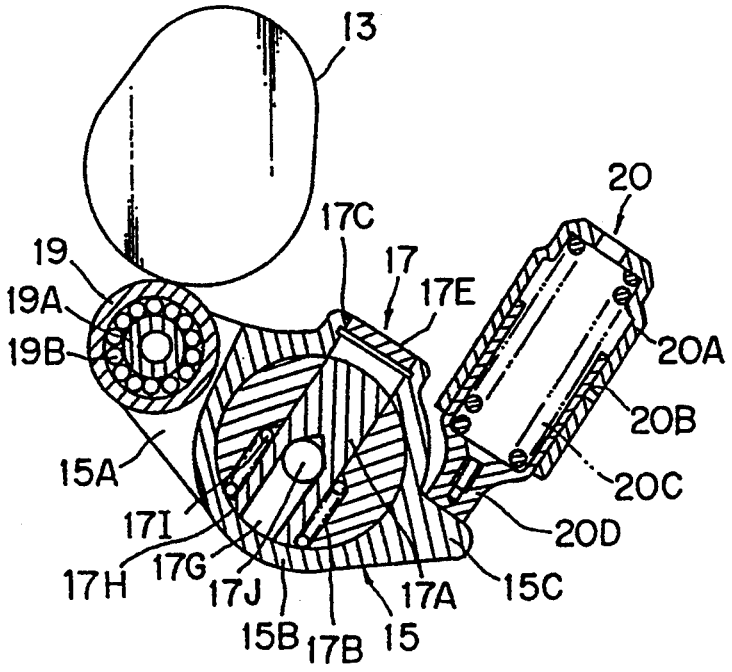
FIG. 4 is a sectional view taken along line IV—IV of FIG. 2 showing mode change-over means mounted in the valve operating system structure with a variable valve timing mechanism.

Meanwhile, referring to FIGS. 2 and 4, the sub rocker arm 15 is supported at a tubular base portion 15B thereof for pivotal motion on the rocker shaft 16, that is, the main rocker arm 14, and a roller 19 for a high speed is mounted at a rocking end portion 15A of the sub rocker arm 15 for contacting with the high speed cam 13. Also the high speed roller 19 is supported for smooth rotation by means of a roller bearing 19B on a shaft 19A supported for rotation at the rocking end portion 15A of the sub rocker arm 15.

A hydraulic piston mechanism 17 is provided between the sub rocker arm 15 and the rocker shaft 16 and serves as mode change-over means for changing over the operation mode of the sub rocker arm 15 between a non-interlocking mode in which the sub rocker arm 15 is pivotable with respect to the rocker shaft 16 and does not operate in an interlocking relationship with the main rocker arm 14 and another interlocking mode in which the sub rocker arm 15 pivots integrally with the rocker shaft 16 and operates in an interlocking relationship with the main rocker arm 14.

The hydraulic piston mechanism 17 serving as mode change-over means includes a piston 17A disposed for movement in a diametrical direction of the rocker shaft 16 in a piston chamber formed in the rocker shaft 16. The piston 17A has a recess formed at an axial portion adjacent a lower or base end side thereof in FIG. 4, and a hydraulic chamber 17G is defined between the recess of the piston 17A and an inner circumferential face of the tubular base portion 15B of the sub rocker arm 15.

A flange portion 17H is formed on an outer periphery of the base end of the piston 17A while a stepped portion 17I is formed on the inner wall of the piston chamber, and a coil spring 17B is fitted in a compressed condition between the flange portion 17H and the stepped portion 17I. Accordingly, the piston 17A is normally biased toward the base end portion thereof by the spring 17B.

A hole 17C is formed at a portion of the tubular base portion 15B of the sub rocker arm 15 such that the other end of the piston 17A, that is, the upper end in FIG. 4, can be fitted into it.

Operating oil is introduced into the hydraulic chamber 17G by way of an oil passage 16A formed in the rocker shaft 16 along the axis. When operating oil is supplied into the hydraulic chamber 17G, the piston 17A is operated toward its upper end side in FIG. 4 against the biasing force of the spring 17B so that the end portion thereof is fitted into the hole 17C. Meanwhile, if supply of operating oil into the hydraulic chamber 17G is interrupted, then the piston 17A is moved reversely toward its base end side by the biasing force of the spring 17B so that the upper end thereof in FIG. 4 is removed from within the hole 17C.

In short, when operating oil is supplied into the hydraulic chamber 17G, the upper end portion of the piston 17A in FIG. 4 is fitted into the hole 17C to put the sub rocker arm 15 into the interlocking mode in which the sub rocker arm 15 rotates integrally with the rocker shaft 16 and operates in an interlocking relationship with the main rocker arm 14, but when supply of operating oil into the hydraulic chamber 17G is interrupted, the upper end portion of the piston 17A in FIG. 4 is removed from the hole 17C to put the sub rocker arm 15 into the non-interlocking mode in which the sub rocker arm 15 is pivotable relative to the rocker shaft 16 and does not operate in an interlocking relationship with the main rocker arm 14.

A check ball 17J is located at the interior of the hydraulic chamber 17G so that the oil pressure in the hydraulic chamber 17G may be kept within a predetermined range. Meanwhile, an oil hole (not shown) is formed in the rocker shaft 16 and the tubular base portion 15B of the sub rocker arm 15 for allowing part of operating oil in the hydraulic chamber 17G to leak to the outside to adjust the pressure of the operating oil within the predetermined range.

Operating oil is supplied into the hydraulic chamber 17G by means of an operating oil supply system (not shown). The operating oil supply system includes a hydraulic pump connected to be driven by the engine or a like apparatus, pressure regulating means for regulating operating oil pressurized by the hydraulic pump to a predetermined hydraulic pressure, and a cut-off poppet valve for changing over between a supplying condition wherein operating oil of a pressure regulated by the pressure regulating means is supplied into the hydraulic chamber 17G by way of the oil passage 16A and another non-supplying condition wherein the operating oil is not supplied into the hydraulic chamber 17G. The cut-off poppet valve may be constituted, for example, from a solenoid valve which can be electronically controlled by means of a controller (not shown). The sub rocker arm 15 can thus be changed over appropriately between the interlocking mode and the non-interlocking mode while the cut-off popper valve is controlled in response to the speed of rotation of the engine or some other parameter.

Referring now to FIG. 3, a spring retainer 5 is provided adjacent an upper end of the valve stem 6 of the valve 2 while another spring retainer (not shown) is provided on the cylinder head 1, and a valve spring 4 is disposed between the two spring retainers so that the valve 3 is normally biased in its closing direction, that is, toward the upper end side of the valve stem 6. Accordingly, also the main rocker arm 14 is normally biased toward the cam 12 side by the valve spring 4, and the biasing force of the valve spring 4 acts as a returning force for the main rocker arm 14 upon rocking motion.

On the other hand, the sub rocker arm 15 is integrated, when in the interlocking mode, with the main rocker arm 14 and acted upon by the biasing force of the valve spring 4, but when in the non-interlocking mode, the sub rocker arm 15 is not acted upon by the biasing force. Accordingly, means for biasing, for example, the sub rocker arm 15 toward the cam 13 side must necessarily be provided so that the sub rocker arm 15 may follow up the cam 13. To this end, a lost motion mechanism 20 is provided for the sub rocker arm 15.

Referring to FIG. 4, the lost motion mechanism 20 includes a lost motion holder (not shown) provided on the cylinder head 1 or a like element, an outer case 20A secured to the lost motion holder, an inner case 20B mounted for back and forth movement in the outer case 20A such that it may not be removed from the outer case 20A, a spring 20C interposed between the outer case 20A and the inner case 20B, and a contacting portion 20D formed at an end portion of the inner case 20B. A lever portion 15C is provided on the sub rocker arm 15 and contacts with the contacting portion 20D of the lost motion mechanism 20, and the sub rocker arm 15 is resiliently pressed against the cam 13 by the biasing force of the spring 20C of the lost motion mechanism 20 to perform a predetermined operation in response to the cam 13.

It is to be noted that the spring force of the lost motion spring 20C is set so as to overcome a force of inertia acting upon the secondary rocker arm 15 for a high speed.

While the valve clearance between the main rocker arm 14 and the valve 2 is automatically adjusted by the hydraulic lash adjuster 81, since the valve clearance when the sub rocker arm 15 is in the interlocking mode in which the main rocker arm 14 operates integrally with the sub rocker arm 15 is different from that when the sub rocker arm 15 is in the non-interlocking mode, it is desired to allow the valve clearance in the interlocking mode of the sub rocker arm 15 (that is, during high speed operation) to be adjusted by some means. It is to be noted -that adjustment of the valve clearance here principally is initial adjustment upon assembly of the valve operating system.

Therefore, in the present valve operating system structure, a plurality of rollers having different outer diameters are prepared for the high speed roller 19, and one of the rollers having a suitable diameter is selected and assembled as the high speed roller 19 to the sub rocker arm 15 so that the valve clearance of the main rocker arm 14 may have a suitable value when the sub rocker arm 15 is in the interlocking mode.

Further, in the present valve operating system, the low speed roller 18 is made of a material lighter in weight than that of the high speed roller 19. In short, while the high speed roller 19 is made of a popular metal material of the iron type, the low speed roller 18 is made of a material having a lighter weight and a predetermined abrasion resistance such as a ceramic material.

The valve operating system structure with a variable valve timing mechanism of the first embodiment of the present invention is constructed in such a manner as described above. Accordingly, when the engine rotates at a low speed, operating oil in the hydraulic chamber 17G is discharged to allow the piston 17A to be moved away from the hole 17C.

Consequently, the sub rocker arm 15 is put into the non-interlocking mode in which it is pivotable relative to the rocker shaft 16 and does not operate in an interlocking relationship with the main rocker arm 14. Then, the main rocker arm 14 is operated in accordance with the cam profile of the low speed cam 12 for a low speed valve timing by way of the low speed roller 18, which contacts with and is operated by the low speed cam 12, and the valve 2 is operated by way of the swing arm 80 from the main rocker arm 14.

As a result, the valve 2 is operated at a valve timing suitable for low speed rotation so that the engine operates efficiently.

On the other hand, when the engine rotates at a high speed, operating oil is supplied into the hydraulic chamber 17G by the oil pressure supply system (not shown) to cause the piston 17A to be fitted into the hole 17C.

Consequently, the sub rocker arm 15 is put into the interlocking mode in which it is integrated with the rocker shaft 16 and operates in an interlocking relationship with the main rocker arm 14. Thus, the main rocker arm 14 is operated in accordance with the cam profile of the high speed cam 13 for a high speed valve timing by way of the high speed roller 19, which contacts with and is operated by the high speed cam 13, and the sub rocker arm 15, and the valve 2 is operated by way of the swing arm 80 from the main rocker arm 14.

As a result, the valve 2 is operated at a valve timing suitable for high speed rotation so that the engine operates efficiently.

When the present valve operating system operates, the hydraulic lash adjuster 81 interposed between the main rocker arm 14 and the swing arm 80 automatically adjusts the relative phase between the swing arm 80 and the main rocker arm 14. Consequently, the relative phase between the swing arm 80 and the main rocker arm 14 is maintained appropriately and the clearance between the main rocker arm 14 and the valve 2 by way of the swing arm 80 is always kept appropriately without particular maintenance of any element. As a result, the effects of vibrations and noise which are liable to be produced with a valve operating system are reduced and that the reliability of the variable valve timing mechanism is enhanced.

Further, in the present embodiment, since the hydraulic lash adjuster 81 is disposed on the center of rocking motion of the main rocker arm 14, an increase of the valve side conversion weight of the valve operating system is suppressed and the operating characteristic of the valve 2 is enhanced such that the valve 2 operates appropriately particularly even when the engine rotates at a high speed. Consequently, the output performance of the engine can be enhanced particularly with regard to the high speed performance.

Further, since the hydraulic lash adjuster 81 is disposed on the center of rocking motion of the main rocker arm 14, the acceleration and the centrifugal force acting upon the check valve bali 81H of the hydraulic lash adjuster 81 are suppressed so that the hydraulic lash adjuster 81 operates appropriately. Consequently, the variable valve timing mechanism operates appropriately and a valve lift curve just as designed can be obtained, and consequently, the total performance of the engine, that is, the performance with regard to the output power, the fuel cost and so forth, can be enhanced.

Further, since the swing arm 80 is supported for pivotal motion on the shaft 18A for the low speed roller 18, the structure there is simplified, which allows the valve operating system to be constructed compact and increases the degree of freedom in design and also contributes to enhancement of its durability.

Furthermore, since the oil passage 16C for supplying operating oil to the hydraulic lash adjuster 81 is formed at the portion of the rocker shaft 16 along the axis, the oil passage 16C can be provided readily and the structure is simplified, and operating oil can be supplied with a higher degree of certainty. Consequently, the reliability of the hydraulic lash adjuster 81 is enhanced.

While, in the present structure, the hydraulic lash adjuster 81 is disposed on the center of rocking motion of the main rocker arm 14, the location of the hydraulic lash adjuster 81 must only be designed in accordance with the requirement that, as shown in FIG. 15, the distance H from the center of rocking motion of the main rocker arm 14 to the axial line of the hydraulic lash adjuster 81 is set smaller than the sum $(d/2+D/2)$ of the radius $(=d/2)$ of the oil passage 16C and the radius $(=D/2)$ of the hydraulic lash adjuster 81.

Figure 16:
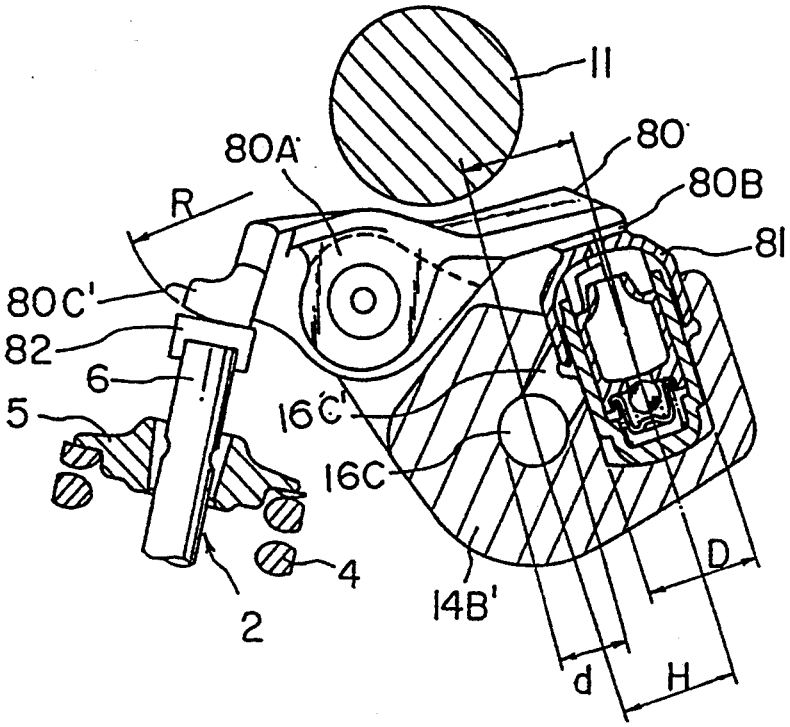
FIG. 16 is a similar view but showing a comparative arrangement of the hydraulic lash adjuster system of the valve operating system structure with a variable valve timing mechanism shown in FIG. 1.

In short, depending upon the arrangement of the hydraulic lash adjuster 81, in addition to the oil passage 16C, an oil passage for establishing communication from the oil passage 16C to the hydraulic lash adjuster 81 may be required, for example, if the hydraulic lash adjuster 81 is disposed at a location displaced by a great distance from the axis of the rocker shaft 16 as shown in FIG. 16, operating oil cannot be introduced from the oil passage 16C in the rocker shaft 16 directly into the hydraulic lash adjuster 81, and a communicating oil passage 16C must necessarily be provided between the oil passage 16C and the hydraulic lash adjuster 81, which complicates the structure. It is to be noted that, in FIG. 16, reference character 14B denotes a rocker shaft side base portion of the main rocker arm 14.

In contrast, where the oil passage 16C is formed at the portion of the rocker shaft 16 along the axis and the distance H is set to $H<d/2+D/2$ as described above, the oil passage 16C and the hydraulic lash adjuster 81 overlap with each other so that operating oil can be introduced from the oil passage 16C in the rocker shaft 16 directly into the hydraulic lash adjuster 81.

Consequently, the effect that provision of the oil passage 16C can be simplified and the effect that the valve side conversion weight of the valve operating system can be reduced can both be obtained as described above. Further, since the distance B (refer to FIG. 15) between the check valve ball 81H of the hydraulic lash adjuster 81 and the center of rocking motion of the rocker arm 14 is short, the acceleration and the centrifugal force acting upon the check valve ball 81I are low.

Meanwhile, where the force acting between the swing arm 80 and the hydraulic lash adjuster 81 is represented by P1 and the force acting between the swing arm 80 and the valve 2 is represented by P2, if the moment at the swing arm 80 is considered based on the distance a between the axial line of the hydraulic lash adjuster 81 and the center of rocking motion of the swing arm 80 and the distance b between the center of rocking motion of the swing arm 80 and the axial line of the valve 2, then the following relationship stands:

$$P1 \cdot a = P2 \cdot b$$

Then, in the present structure, since the distance a between the axial line of the hydraulic lash adjuster 81 and the center axis of pivotal motion of the swing arm 80 is set larger than the distance b between the center of rocking motion of the swing arm 80 and the axial line of the valve 2, that is, $b<a$, $b/a<1$, and re-configuring the equation above, from $b/a=P1/P2$. $P1/P2<1$, that is, $P1<P2$, is obtained. In short, the force P1 acting upon the hydraulic lash adjuster 81 is smaller than the force P2 acting upon the valve 2.

Consequently, the burden to the hydraulic lash adjuster 81 can be reduced comparing with that when the hydraulic lash adjuster 81 is provided at the location of the valve 2, and accordingly, the hydraulic lash adjuster 81 may be reduced in capacity and size. As a result, the overall weight of the valve operating system can be reduced, and enhancement of the high speed performance of the valve operating system and decrease of the weight of the entire engine can be achieved.

Naturally, the leverage between the distance a between the axial line of the hydraulic lash adjuster 81 and the center of rocking motion of the swing arm 80 and the distance b between the center of rocking motion of the swing arm 80 and the axial line of the valve 2 can be set freely under the requirement of $b/a<1$. Thus, the leverage b/a can be set in accordance with the capacity of an available hydraulic lash adjuster.

Meanwhile, upon high speed operation, a lift of the high speed cam 13 is transmitted from the sub rocker arm 15 to the rocker shaft 16 by way of the piston (plunger) 17A and further from the main rocker arm 14 to the valve 2 by way of the swing arm 80.

In this instance, the rocker shaft 16 which transmits rocking motion of the sub rocker arm 15 to the main rocker arm 14 undergoes torsion, which is a factor of deterioration of the rigidity of the entire valve operating system.

Figure 11A:
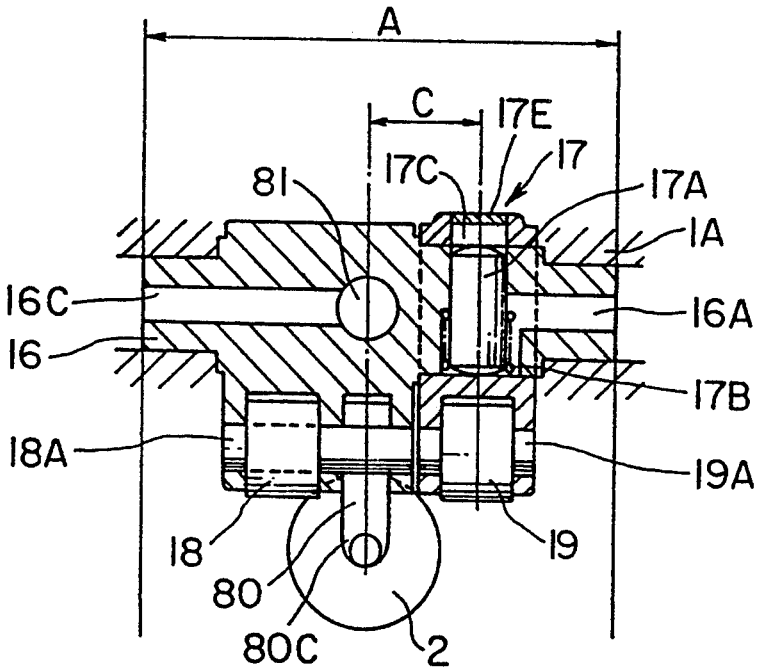
FIGS. 11(A) and 11(B) are sectional views illustrating an advantage of the valve operating system structure with a variable valve timing mechanism shown in FIG. 1.

With the present structure, however, since the hydraulic lash adjuster 81 is disposed at the rocker shaft side base portion 14B of the main rocker arm 14 between the main rocker arm 14 and the sub rocker arm 15, the piston (plunger) 17A and the center of the swing arm 80 are located near to each other as seen from the distance C in FIG. 11(A), and consequently, the influence of the torsion of the rocker shaft 16 upon the rigidity of the entire valve operating system is minimized and the rigidity of the valve operating system is assured.

Figure 11B:
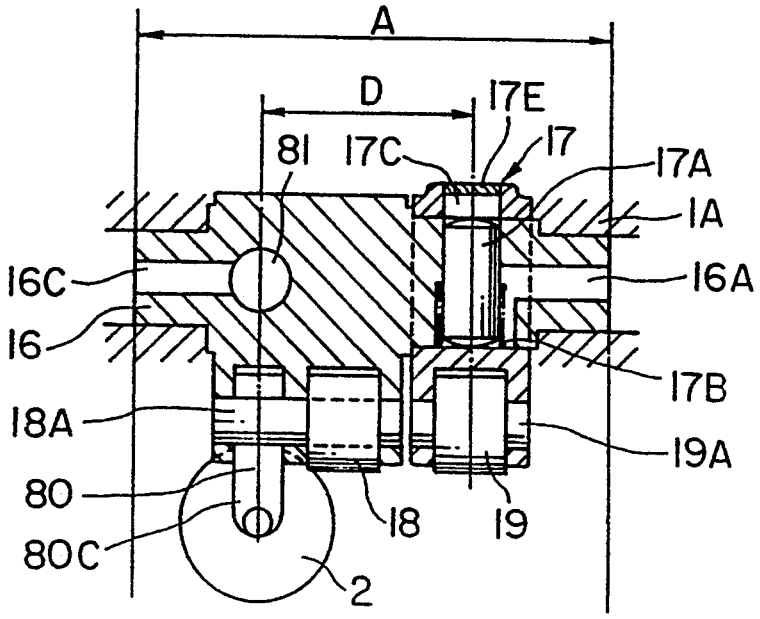

It is to be noted that FIG. 11(B) shows an arrangement wherein the hydraulic lash adjuster 81 and the swing arm 80 are provided at an end of the valve operating system. From comparison between the distance D between the piston (plunger) 17A and the center of the swing arm 80 in the arrangement shown in FIG. 11(B) and the distance C in the structure of the present invention, it can be seen that the distance C in the structure of the invention is smaller. It is to be noted that the distance A in FIGS. 11(A) and 11(B) denotes the overall width of the valve operating system.

Due to the structure described above, the operating characteristic of the valve 2 is enhanced and operates as designed. Accordingly, the output performance and so forth of the engine are enhanced and also the durability of the valve operating system is enhanced.

Further, if the hydraulic lash adjuster 81 is disposed at the rocker shaft side base portion 14B between the main rocker arm 14 and the sub rocker arm 15, then since a sufficient distance can be assured between the low speed cam 12 and the high speed cam 13, even when the cams 12 and 13 are manufactured together with the cam shaft 11 by casting, the possibility of low mold drawability is eliminated and the workability is enhanced to facilitate manufacture.

Further, since a sufficient distance can be assured between the low speed cam 12 and the high speed cam 13, the possibility that, when the low speed cam 12 is polished, the grind stone may interfere with the high speed cam 13 which projects farther than the low speed cam 12 is eliminated.

Furthermore, since the swing arm 80 is supported for pivotal motion on the shaft 18A for the low speed roller 18, the structure there is simplified, which allows the valve operating system to be constructed more compact, resulting in increase of the degree of freedom in design and contributing to enhancement of its durability.

Figure 12A:
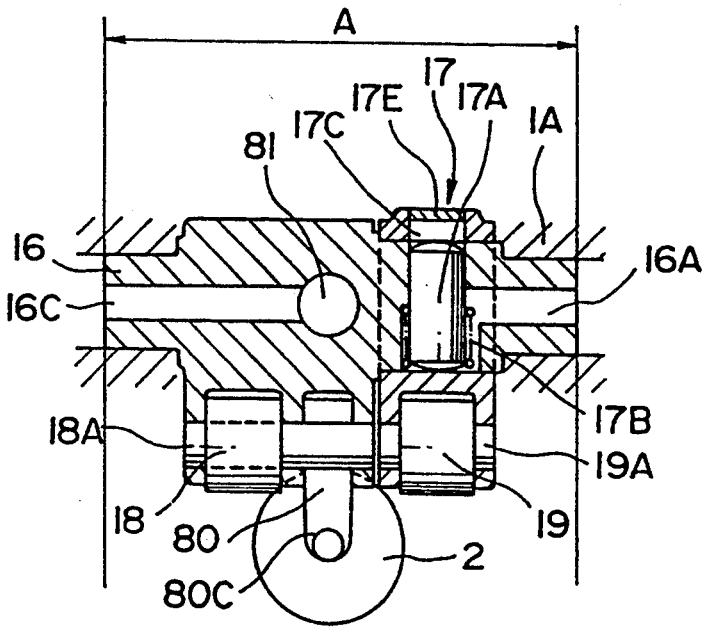
FIGS. 12(A) and 12(B) are similar views but illustrating another advantage of the valve operating system structure with a variable valve timing mechanism shown in FIG. 1.

Further, since the swing arm 80 is supported for pivotal motion on the shaft 18A for the low speed roller 18, the number of parts is reduced and the structure there is simplified as seen from FIG. 12(A), and consequently, the part cost and the assembly cost are reduced.

Figure 12B:
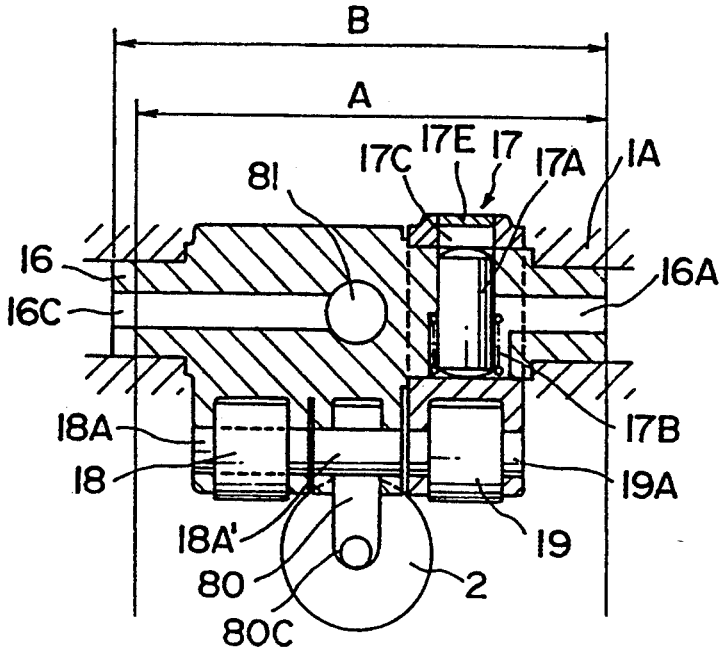

It is to be noted that FIG. 12(A) shows the present structure when the shaft 18A for the low speed roller 18 serves also as a shaft for the swing arm 80, and in FIG. 12(A), the overall width of the valve operating system is indicated by A. FIG. 12(B) shows another structure wherein the shaft 18A for the low speed roller 18 does not serve as a shaft for the swing arm 80, and the overall width of the valve operating system is indicated by B. From comparison between them, it can be seen that, where the shaft 18A serves as a shaft for the swing arm 80, the overall width of the valve operating system is smaller.

In this manner, the valve operating system can be constructed more compactly and the degree of freedom in design is enhanced, and the decrease of the weight of the valve operating system can contribute to enhancement of the high speed performance of the valve operating system and enhancement of the durability. Further, the overall weight of the engine can be reduced.

Further, since the oil passage 16C for supplying operating oil to the hydraulic lash adjuster 81 therethrough is formed at the portion of the rocker shaft 16 along the axis, providing of the oil passage 16C can be performed readily and the structure is simplified, and operating oil can be supplied with certainty, resulting in enhancement of the reliability of the hydraulic lash adjuster 81.

With the variable valve timing mechanism described above, since also the structure of the hydraulic piston mechanism 17 is simple and small in size and is also installed at or in the proximity of the axis of the rocker arm 16, the degree of freedom in design is enhanced and the increase of the valve side conversion weight of the valve operating system is suppressed. Consequently, it is possible to provide the low speed roller 18 on the main rocker arm 14 and provide the high speed roller 19 on the sub rocker arm 15. Then, since the rocker arms 14 and 15 are contacted with the low speed cam 12 and the high speed cam 13 by way of the rollers 18 and 19, respectively, abrasion at the contacting portions of the rocker arms 14 and 15 with the cams 12 and 13 is suppressed, and consequently, the valve operating system can maintain a required performance for a long period of time.

Further, since the hydraulic lash adjuster 81 is mounted in an upwardly directed condition (with the cap 81D directed upwardly) in the depressed portion of the rocker shaft side base portion 14B of the main rocker arm 14 positioned between the main rocker arm 14 and the sub rocker arm 15, there is no possibility that the hydraulic lash adjuster 81 may be removed, and ease of assembly is enhanced.

While, in the embodiment described above, only one valve which may be an intake valve or an exhaust valve is provided, the valve operating system may be modified so that it includes two such valves.

Figure 5:
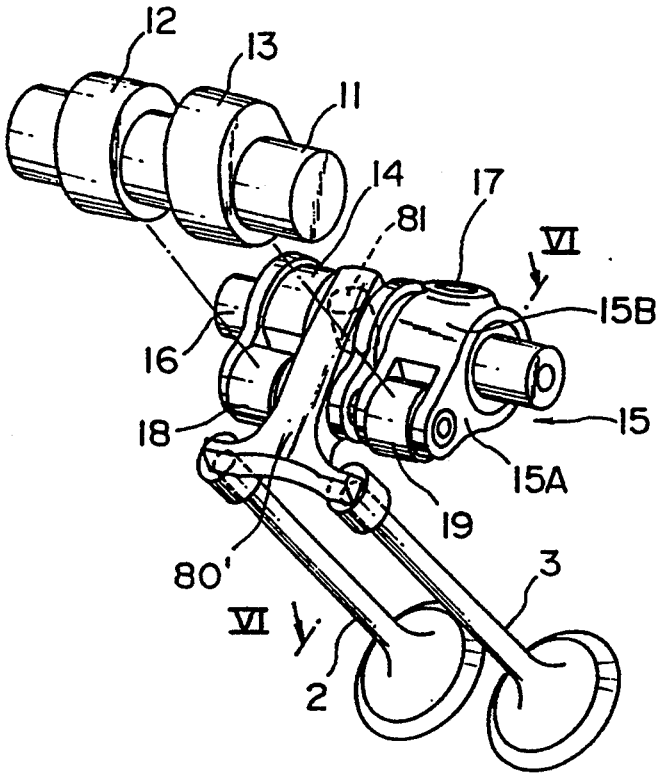
FIG. 5 is a schematic perspective view showing part of a modification to the valve operating system structure with a variable valve timing mechanism shown in FIG. 1.

Referring now to FIG. 5, there is shown a valve operating system modified in such a manner as described just above. The modified valve operating system is provided for two valves 2 and 3 and is constructed so as to drive the valves 2 and 3 to open or close. Accordingly, in order to drive the valves 2 and 3, an end portion of a swing arm 80' at which the swing arm 80' contacts with the valves 2 and 3 is bifurcated into two valve contacting portions 80C for contacting with ends of stems 6 of the valves 2 and 3.

In order to operate the valves 2 and 3 simultaneously at an accurate timing by means of the single swing arm 80', the clearances between the valve contacting portions 80C of the swing arm 80' and the ends of the stems 6 of the valves 2 and 3 must necessarily be adjusted appropriately.

Figure 7:
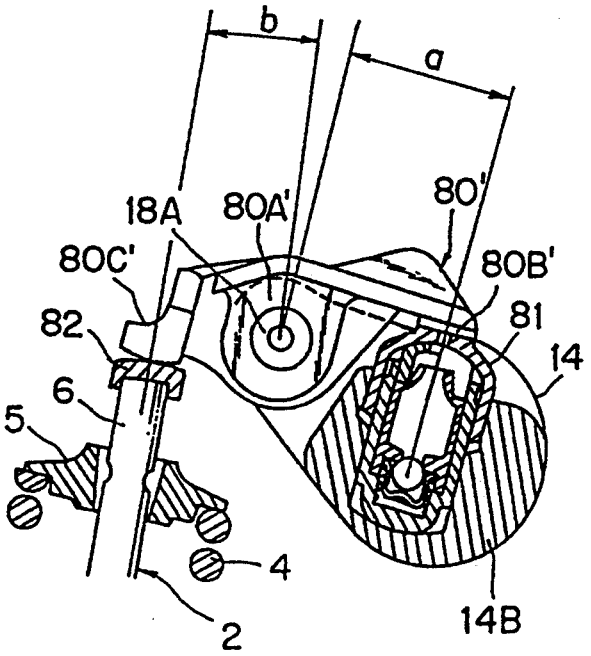
FIG. 7 is a sectional view taken along line VII—VII of FIG. 6 showing a hydraulic lash adjuster mounted in the modified valve operating system structure with a variable valve timing mechanism.
Figure 8:
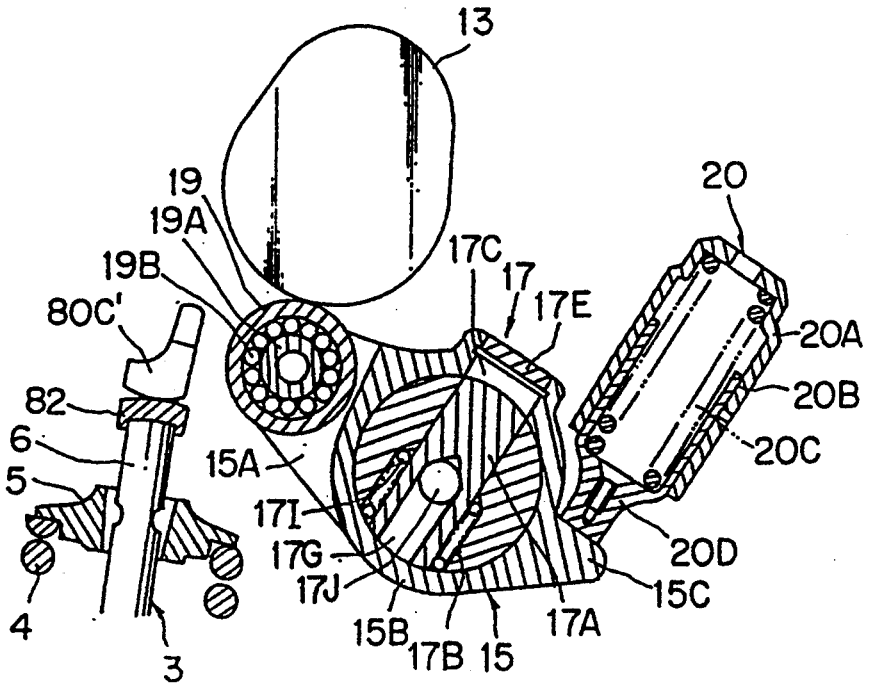
FIG. 8 is a sectional view taken along line VIII—VIII of FIG. 6 showing mode change-over means mounted in the modified valve operating system structure with a variable valve timing mechanism.

To this end, in the modified valve operating system with a variable valve timing mechanism, a shim 82 is mounted at the end of the valve stem 6 of one or each of the valves 2 and 3 as seen in FIGS. 7 and 8 to effect adjustment of the clearance or clearances. In short, a shim having a suitable thickness is mounted as the shim 82 in accordance with the condition of the clearance to adjust the clearance.

The modified valve operating system structure is constructed similarly to the valve operating system structure of the embodiment described above except the structure of and around the valve contacting portions 80C of the swing arm 80', and accordingly, it operates in a similar manner as described above and exhibits similar effects to those of the valve operating system structure of the embodiment described above.

Figure 6:
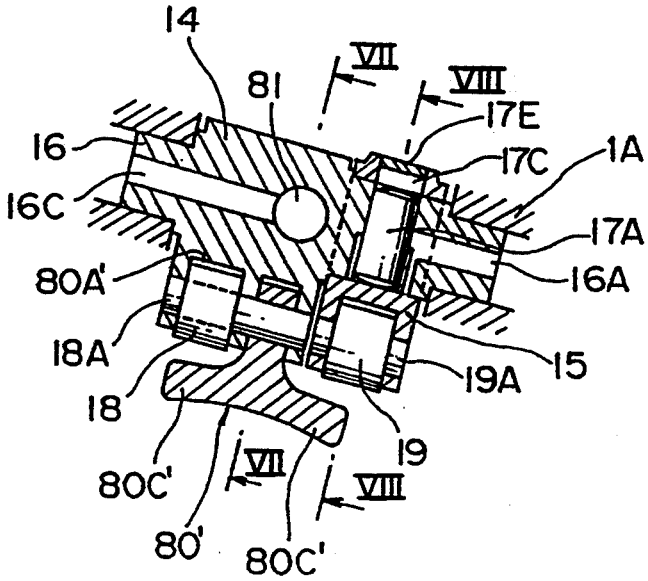
FIG. 6 is a schematic sectional view taken along line VI—VI of FIG.

In the valve operating system structure of such two-valve type, since the two valves are disposed in a direction along the axis of the cam shaft 11 and hence of the rocker shaft 16, the valve operating system may be increased in size in the direction of the shaft 11 or 16. Particularly, since the two valves are disposed, taking the balance into consideration, at equal distances from the center line of the swing arm 80' as seen from FIGS. 5 and 6, depending upon the position of the swing arm 80', for example, one of the valves 2 and 3 may possibly project farther than an end of the rocker shaft 16.

With the modified structure, however, since the hydraulic lash adjuster 81 is disposed at the rocker shaft side base end 14B of the main rocker arm 14 between the main rocker arm 14 and the sub rocker arm 15, also the swing arm 80' is disposed between the main rocker arm 14 and the sub rocker arm 15, that is, at the middle in the direction of the shaft 11 or 16 of the valve operating system, and consequently, the piston (plunger) 17A and the center of the swing arm 80' are located closely to each other. As a result, the influence of torsion of the rocker shaft 16 upon the rigidity of the entire valve operating system is minimized and the valves 2 and 3 are prevented from projecting farther than the end of the rocker shaft 16, and consequently, the size of the valve operating system in the direction of the shaft 11 or 16 is minimized.

Figure 13A:
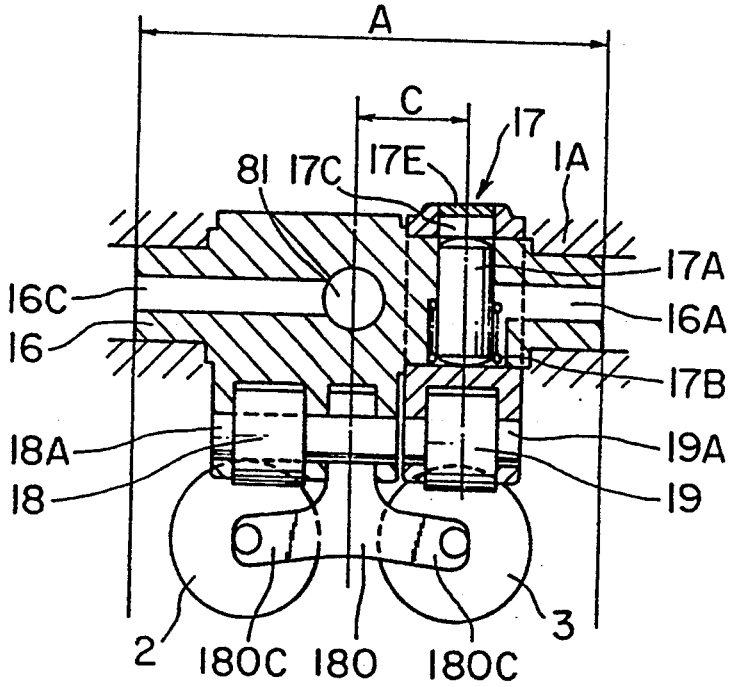
FIGS. 13(A) and 13(B) are similar views but illustrating an advantage of the modified valve operating system structure with a variable valve timing mechanism shown in FIG. 5.
Figure 13B:
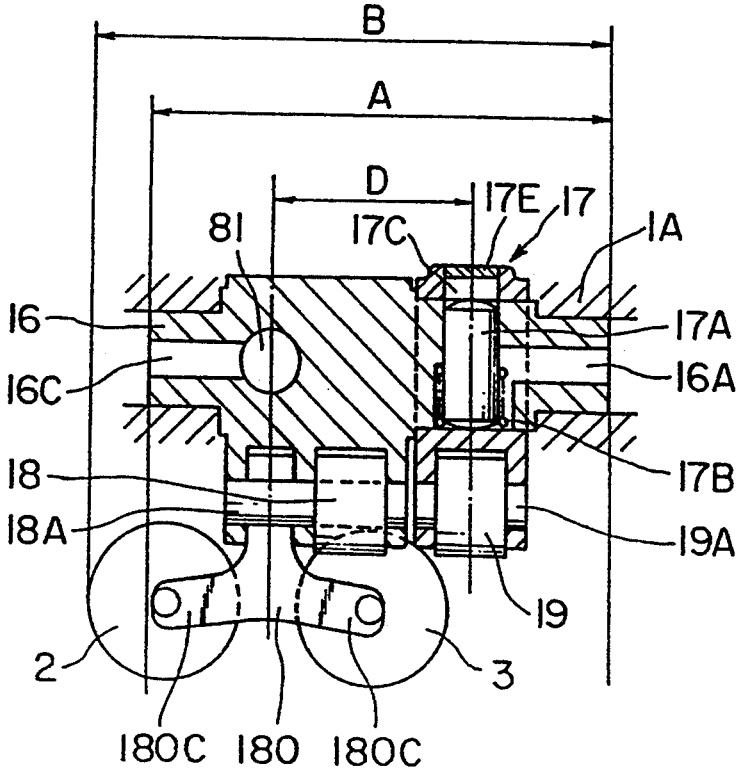

For example. FIG. 13(A) shows the arrangement of the present structure while FIG. 13(B) shows an alternative arrangement wherein the hydraulic lash adjuster 81 and the swing arm 180 are located at an end of the valve operating system. From comparison between the distance D between the piston (plunger) 17A and the center of the swing arm 180 in the arrangement of FIG. 13(B) and the distance C in the present structure, it can be seen that the distance C in the present structure is smaller. Also it can be seen that, where the piston (plunger) 17A and the swing arm 180 are arranged at an end of the valve operating system, the overall width of the valve operating system is increased by the distance D and the size of a valve.

Figure 14A:
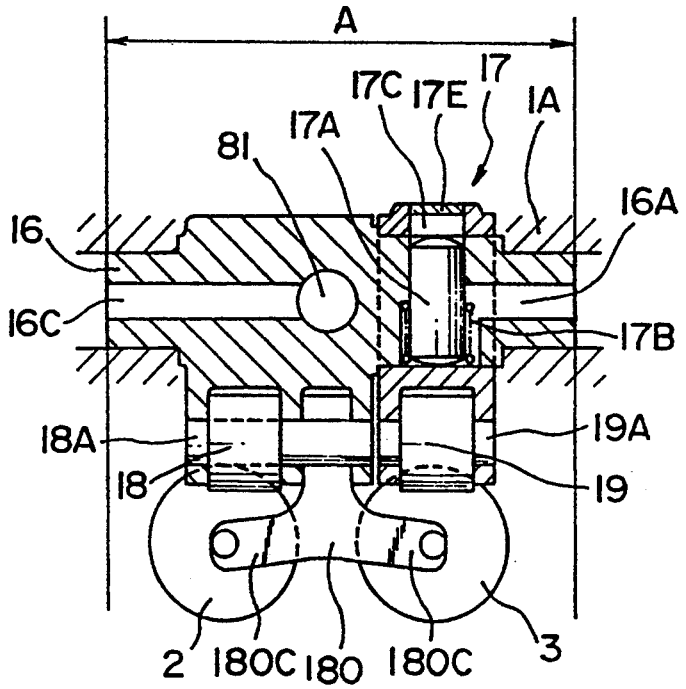
FIGS. 14(A) and 14(B) are sectional views but illustrating another advantage of the modified valve operating system structure with a variable valve timing mechanism shown in FIG. 5.

Further, since the swing arm 180 is supported for pivotal motion on the shaft 18A for the low speed roller 18, the number of parts is reduced and the structure there is simplified as seen from FIG. 14(A). Also this is effective to reduce the part cost and the assembly cost.

Figure 14B:
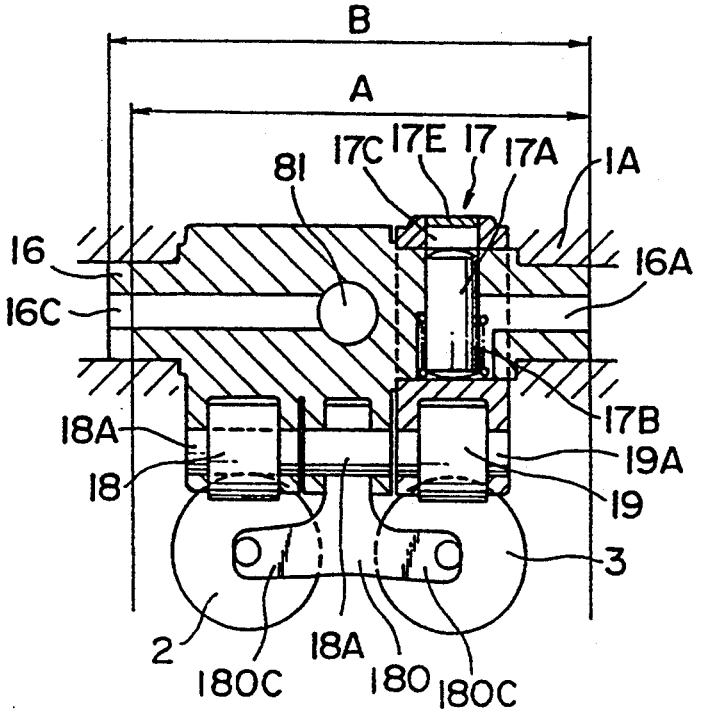

It is to be noted that FIG. 14(A) shows the present structure wherein the shaft 18A for the low speed roller 18 serves also as a shaft for the swing arm 180, and the overall width of the valve operating system is given by A. Meanwhile, FIG. 14(B) shows an alternative structure wherein the shaft 18A for the low speed roller 18 does not serve as a shaft for the swing arm 180 and the low speed roller 18 and the swing arm 180 are supported on separate individual shafts, and the overall width of the operating system is given by B. From comparison between them, the overall width of the valve operating system is reduced where the shaft is used commonly for the different elements.

In this manner, the valve operating system can be constructed more compactly and the degree of freedom in design is enhanced, and the decrease of the weight of the valve operating system can contribute to enhancement of the high speed performance of the valve operating system and enhancement of the durability. Furthermore, the overall weight of the engine can be decreased.

The valve operating system of the embodiment described above may otherwise be modified so as to include a cylinder suspending mechanism. The valve operating system of the modified form is shown in FIG. 17.

Figure 17:
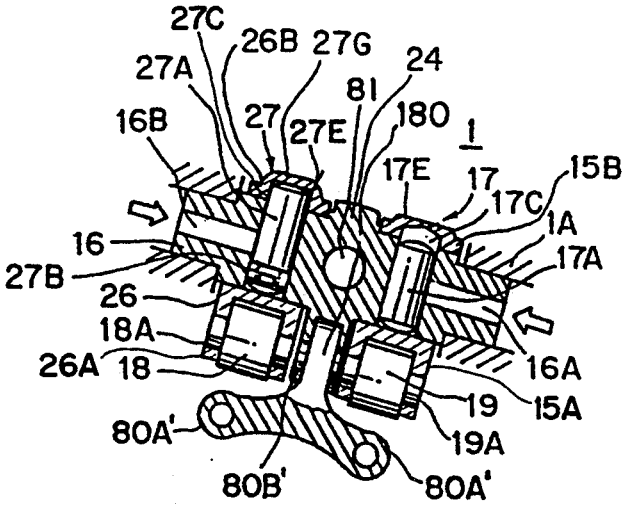
FIG. 17 is a schematic sectional view similar to FIG. 6 but showing another modification to the valve operating system structure with a variable valve timing mechanism shown in FIG. 1.

Referring to FIG. 17, the modified valve operating system additionally has a cylinder suspending function and is constructed such that a sub rocker arm 26 contacts with the low speed cab 12 and a Bain rocker arm 24 is operated by the low speed cam 12 by way of the sub rocker arm 26. Further, similarly as in the valve operating system of the embodiment described above, the sub rocker arm 15 contacts with the high speed cam 13, and the main rocker arm 24 can be operated by the high speed cab 13 by way of the sub rocker arm 15.

The main rocker arm 24 is provided integrally with the rocker shaft 16. The rocker shaft 16 is supported for rotation on the bearing portion 1A provided on the cylinder head 1 on the like of the engine, and the main rocker arm 24 can be pivoted around the axis of the rocker shaft 16.

The swing arm 180 is mounted for pivotal motion at a rocking end portion of the main rocker arm 24 by means of a pin 80B'. It is to be noted that, also in the present modified valve operating system, two valves are provided similarly as in the preceding modified valve operating system, and substantially similarly as in the arrangement shown in FIG. 5, the valve contacting portions 80C' formed at the free or rocking end 80A' of the swing arm 180 contact with the two valves 2 and 3.

Similarly as in the preceding modified valve operating system described above, the hydraulic lash adjuster 81 is provided at the other end of the swing arm 180 so that it can adjust the relative phase between the swing arm 180 and the main rocker arm 24 (refer to FIG. 7). Consequently, similarly as in the valve operating system of the embodiment described above, the clearances between the main rocker arm 24 and the valves 2 and 3 are automatically adjusted by way of the swing arm 180.

The sub rocker arm 15 is constructed in a similar manner as that of the valve operating system of the embodiment and is supported at the tubular base portion 15B thereof for pivotal motion with respect to the rocker shaft 16 and hence to the main rocker arm 24. The sub rocker arm 15 has the high speed roller 19 provided at the rocking end portion 15A thereof for contacting with the high speed cam 13. Also the high speed roller 19 is supported for smooth rotation by means of the roller bearing 19B on the shaft 19A supported for rotation at the rocking end portion 15A of the sub rocker arm 15.

Meanwhile, the sub rocker arm 26 is in the form of a rocker arm with a roller similarly to the sub rocker arm 15 and is supported at the tubular base portion 26B thereof for pivotal motion with respect to the rocker shaft 16 and hence the main rocker arm 24. The low speed roller 18 is provided at the rocking end portion 26A of the sub rocker arm 26 for contacting with the low speed cam 12. The low speed roller 18 is supported for smooth rotation by way of the roller bearing 18B on the shaft 18A supported for rotation at the rocking end portion 26A.

A pair of hydraulic piston mechanisms 27 and 17 are provided between the sub rocker arms 26 and 15 and the rocker shaft 16 and serve as mode change-over means for changing over the operation modes of the sub rocker arms 26 and 15 between a non-interlocking mode in which the sub rocker arms 26 and 15 are pivotable with respect to the rocker shaft 16 and do not operate in an interlocking relationship with the main rocker arm 24 and another interlocking mode in which the sub rocker arms 26 and 15 pivot integrally with the rocker shaft 16 and operate in an interlocking relationship with the main rocker arm 24, respectively.

The hydraulic piston mechanism 17 provided for the sub rocker arm 15 is constructed substantially similarly to that in the valve operating mechanism of the embodiment described above.

Meanwhile, the hydraulic piston mechanism 27 provided for the sub rocker arm 26 includes a piston 27A disposed for movement in a diametrical direction of the rocker shaft 16 in another piston chamber formed in the rocker shaft 16. A coil spring 27B is fitted in a compressed condition between a base or lower end as seen in FIG. 17 of the piston 27A and an inner peripheral face of the tubular base portion 26B of the sub rocker arm 26. Accordingly, the piston 27A is normally biased toward the other or upper end portion thereof in FIG. 17 by the spring 27B.

A hole 27C is formed in the wall of the tubular base portion 26B of the sub rocker arm 26 adjacent the upper end in FIG. 17 of the piston 27A and is closed with a lid 27E, and a hydraulic chamber 27G is defined between the inner wall of the hole and the upper end in FIG. 17 of the piston 27A. The upper end of the piston 27A can be advanced into the oil chamber 27G.

Operating oil is introduced into the hydraulic chamber 27G by way of an oil passage 16B formed in a portion of the rocker shaft 16 along the axis. When operating oil is supplied into the hydraulic chamber 27G, the piston 27A is operated toward its base or lower end side in FIG. 17 against the biasing force of the spring 27B so that the upper end portion thereof in FIG. 17 is moved away from the hole 27C. On the other hand, if supply of operating oil into the hydraulic chamber 27G is interrupted, then the piston 27A is moved reversely toward its upper end side in FIG. 17 by the biasing force of the spring 27B so that the upper end thereof is fitted into the hole 27C.

In short, when operating oil is supplied into the hydraulic chamber 27G, the upper end portion of the piston 27A in FIG. 17 is moved away from the hole 27C to put the sub rocker arm 26 into the non-interlocking mode in which the sub rocker arm 26 is pivotable relative to the rocker shaft 16 and does not operate in an interlocking relationship with the main rocker arm 24, but when supply of operating oil into the hydraulic chamber 27G is interrupted, the upper end portion of the piston 27A in FIG. 17 is removed from the hole 27C to put the sub rocker arm 26 into the interlocking mode in which the sub rocker arm 26 rotates integrally with the rocker shaft 16 and operates in an interlocking relationship with the main rocker arm 24.

Operating oil is supplied into the hydraulic chambers 17G and 27G by means of respective operating oil supply systems (not shown). Each of the operating oil supply systems includes a hydraulic pump connected to be driven by the engine or a like apparatus, pressure regulating means for regulating operating oil pressurized by the hydraulic pump to a predetermined hydraulic pressure, and a cut-off popper valve for changing over between a supplying condition wherein operating oil of a pressure regulated by the pressure regulating means is supplied into the hydraulic chamber 17G or 27G by way of the oil passage 16A or 16B and a non-supplying condition wherein the operating oil is not supplied into the hydraulic chamber 17G or 27G. The cut-off popper valve may be constituted, for example, from a solenoid valve which can be electronically controlled by means of a controller (not shown). The sub rocker arm 15 or 26 can thus be changed over appropriately between the interlocking mode and the non-interlocking mode while the cut-off poppet valve is controlled in response to the speed of notation of the engine or some other parameter.

In order for the sub rocker arms 26 and 15 to follow up the cams 12 and 13, respectively, though net shown in FIG. 17, a pain of lost motion mechanisms 20 similar to that in the valve operating system of the embodiment described above are provided. Particularly here, the lost motion mechanisms 20 for the sub rocker arm 26 for a low speed and the sub rocker arm 15 for a high speed are same as each other.

Further, also in the present modified valve operating system, the low speed roller 18 is made of a material lighter in weight than that of the high speed roller 19. In short, while the high speed roller 19 is made of a popular metal material of the iron type, the low speed roller 18 is made of a material having a lighter weight and a predetermined abrasion resistance such as a ceramic material.

The reason why the same lost motion mechanisms 20 are provided for the sub rocker arm 26 for a low speed and the sub rocker arm 15 for a high speed is described below.

In particular, while the lost motion mechanism 20 for the sub rocker arm 26 for a low speed is required to exhibit its lost motion action in a high speed range after the valve driving mode is changed oven to a high speed driving mode, the inertial force acting upon the sub rocker arm 26 for a low speed then increases in response to the speed and also increases from the cam profile of the low speed cam 12 which presents a small valve opening angle. Therefore, generally also the spring force of the lost motion spring 20C of the lost motion mechanism 20 must necessarily be set to a high level so as to overcome the inertial force.

In short, generally the inertial force of the sub rocker arm 26 for a low speed is greater than the inertial force of the sub rocker arm 15 for a high speed, and also the minimum lost motion spring force required for a low speed is required to be greater than that required for a high speed.

However, since the low speed roller 18 provided for the sub rocker arm 26 is made of a material of a lighter weight than that of the high speed roller 19 provided for the sub rocker arm 15 for a high speed, the weight of the sub rocker arm 26 is reduced by the amount, resulting in reduction of the inertial force of the sub rocker arm 26. In short, with the sub rocker arm 26, the inertial force is reduced by an amount corresponding to the reduction in weight of the low speed roller 18.

Accordingly, the minimum lost motion spring force required for the sub rocker arm 26 for a low speed is reduced comparing with that of a conventional arrangement and to such a degree as that for a high speed.

Consequently, even if a lost motion spring force of the magnitude sufficient to provide the minimum lost motion spring force required for the sub rocker arm 26 for a low speed is set to the sub rocker arm 15 for a high speed, the excess amount of the lost motion spring force acting upon the high speed side is a very small amount. Accordingly, even if the same lost motion mechanisms 20 are provided for the sub rocker arm 26 for a low speed and the sub rocker arm 15 for a high speed, no significant loss results.

Rather, where the same lost motion mechanisms 20 are provided for both of the rocker arms 26 and 15, such advantages as reduction of the cost by common use of the part and prevention of an error in assembly of the lost motion mechanisms can be anticipated.

Also with the present modified valve operating mechanism, in order to operate the valves 2 and 3 simultaneously at an accurate timing by means of the single swing arm 180, the clearances between the valve contacting portions 180C of the swing arm 180 and the ends of the corresponding stems 6 of the valves 2 and 3 must necessarily be adjusted appropriately.

Therefore, in the modified valve operating system structure with a variable valve timing mechanism, a shim 82 is mounted at the end of one or each of the stems 6 to adjust the clearances similarly as in the preceding modified valve operating system structure described above (refer to FIGS. 7 and 8).

The presently described modified valve operating system structure is constructed in a similar manner as the valve operating system structure of the embodiment described previously except as specifically noted.

Also with the present modified valve operating system structure of the construction described above, similar action and effects to those of the valve operating system structure of the embodiment described above can be obtained.

Figure 18:
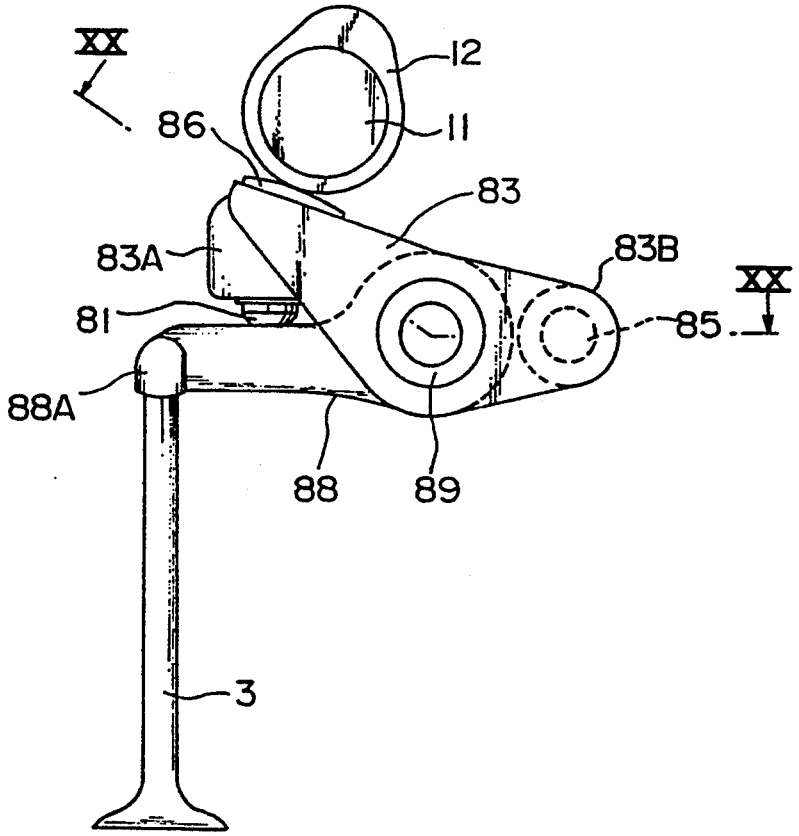
FIG. 18 is a schematic side elevational view of part of another valve operating system structure with a variable valve timing mechanism showing a second preferred embodiment of the present invention.
Figure 19:
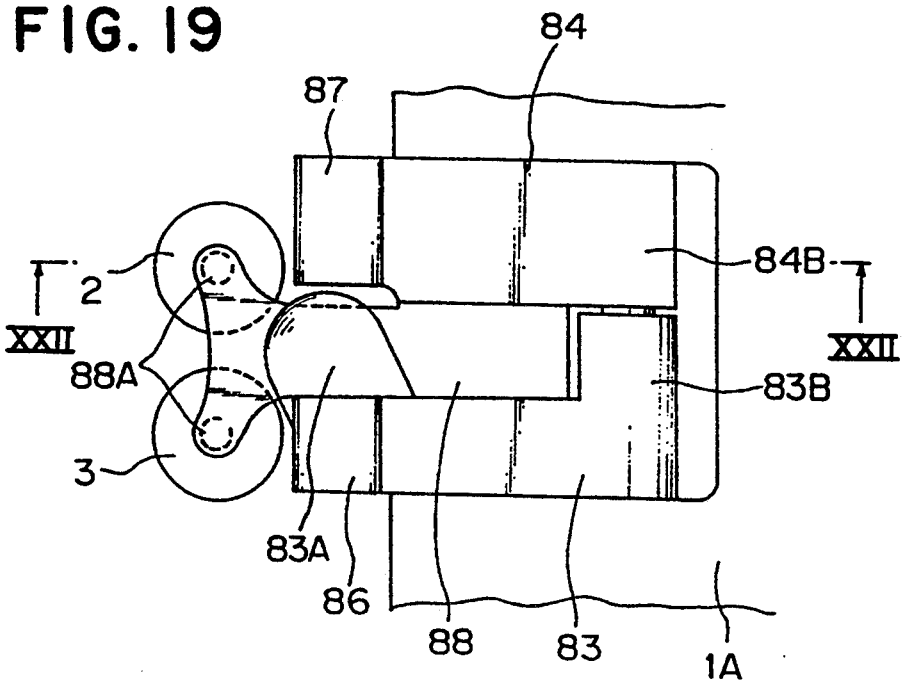
FIG. 19 is a schematic plan view of the valve operating system structure with a variable valve timing mechanism shown in FIG. 18.

Referring now to FIGS. 18 and 19, there is shown another valve operating system structure with a variable valve timing mechanism according to a second preferred embodiment of the present invention. The valve operating system structure shown includes a pair of slipper-shaped rocker arms 83 and 84, and a swing arm 88 interposed between the rocker arms 83 and 84.

Figure 22:
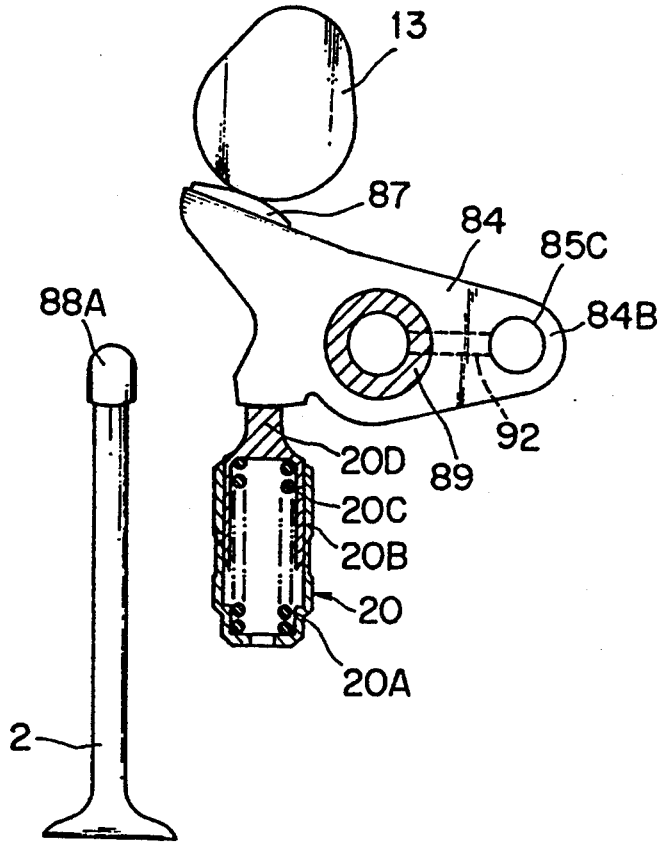
FIG. 22 is a sectional view taken along line XXII—XXII of FIG. 19 showing a sub rocker arm of the valve operating system structure with a variable valve timing mechanism.

The rocker arms 83 and 84 are supported for pivotal motion on a rocker shaft 89, and the rocker arm 83 serves as a main rocker arm having a slipper 86 for contacting with a cam 12 for a low speed as shown in FIG. 18 while the other rocker arm 84 serves as a sub rocker arm including another slipper 87 for contacting with a cam 13 for a high speed as shown in FIG. 22.

It is to be noted that the low speed cam 12 and the high speed cam 13 are constructed in a similar manner as those in the first embodiment and have a cam profile for a valve timing at a low speed and another cam profile for a valve timing at a high speed, respectively, as seen from FIG. 10.

The swing arm 88 is supported at an end thereof on the rocker shaft 89 and has a pair of valve contacting portions 88A provided at the other end thereof for contacting with a pair of valves 2 and 3. A hydraulic lash adjuster 81 contacts with an intermediate portion of the swing arm 88.

The hydraulic lash adjuster 81 is provided to adjust the relative phase between the swing arm 88 and the main rocker arm 83 and is mounted at a hydraulic lash adjuster mounting portion 83A provided on the main rocker arm 83 such that it extends downwardly. The hydraulic lash adjuster 81 has such a structure as described hereinabove and is mounted here such that a portion thereof adjacent the plunger cap 81D side (refer to FIG. 9) is implanted and the other portion thereof on the body 81A side projects as the movable side.

Supply of operating oil into the hydraulic lash adjuster 81 is performed by an operating oil supply system (not shown) by way of an oil passage or operating liquid supply passage 90A formed in the rocker shaft 89 along its axis and another oil passage or operating liquid supply passage 91 formed in the main rocker arm 83 and communicating with the oil passage 90A.

Mode change-over means 85 is interposed between the main rocker arm 83 and the sub rocker arm 84 for changing over between an interlocking mode in which the sub rocker arm 84 for a high speed operates in an interlocking relationship with the main rocker arm 83 and another non-interlocking mode in which the sub rocker arm 84 for a high speed does not operate in an interlocking relationship with the main rocker arm 83.

The mode change-over means 85 is constituted from a hydraulic piston mechanism and located adjacent the ends of the rocker arms 83 and 84 remote from the slippers 86 and 87. The mode change-over means 85 is constructed in such a manner as shown in FIG. 20.

Figure 20:
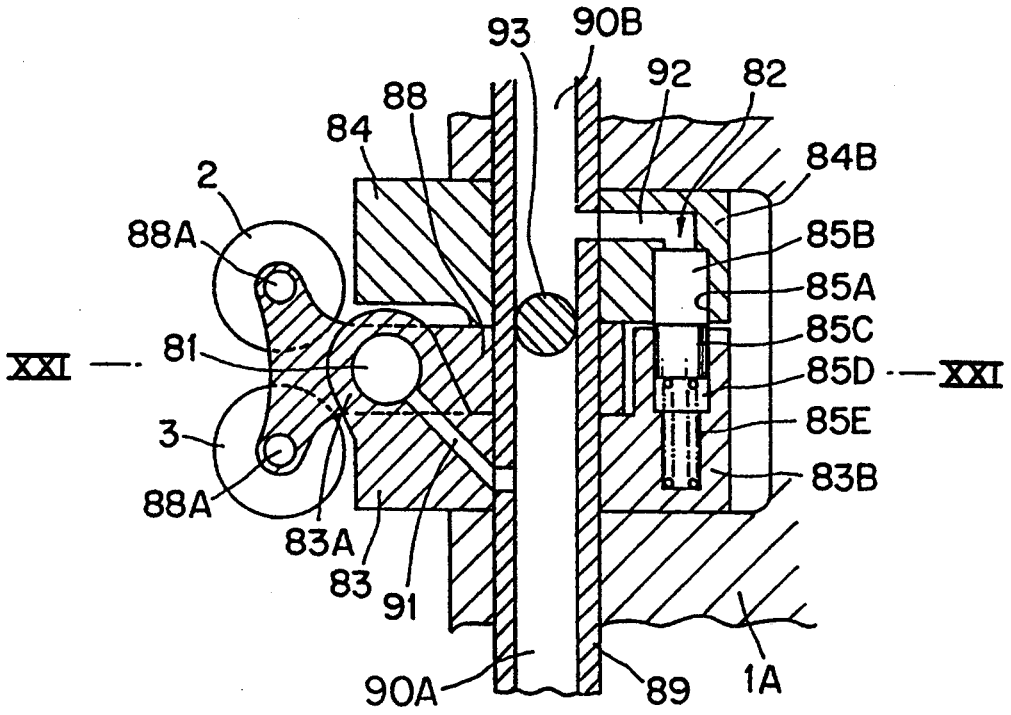
FIG. 20 is a schematic sectional view taken along line XX—XX of FIG. 18 showing mode change-over means mounted in the valve operating system structure with a variable valve timing mechanism.
Figure 21:
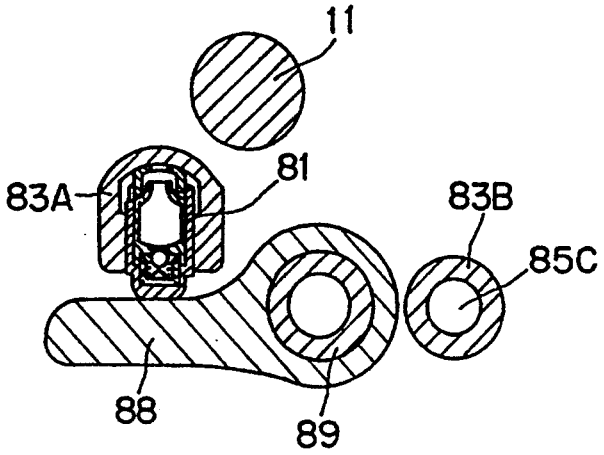
FIG. 21 is a sectional view taken along line XXI—XXI of FIG. 20 showing a hydraulic lash adjuster mounted in the valve operating system structure with a variable valve timing mechanism.

Referring to FIG. 20, the hydraulic piston mechanism 85 serving as the mode change-over means includes a pair of plunger chambers 85A and 85D formed in parallel to the rocker shaft 89 at end portions 84B and 83B of the rocker arms 84 and 83, respectively, and a plunger 85B accommodated in the plunger chamber 85A and a guide plunger 85C accommodated in the other plunger chamber 85D.

The two plunger chambers 85A and 85D are in the form of cylindrical holes of the same profile which are registered with each other on a common axis when the sub rocker arm 84 and the main rocker arm 83 contact with base circle portions of cams 13 and 12, respectively, that is, when the valve operating system is inoperative. Accordingly, when the valve operating system is inoperative, the plunger 85B and the guide plunger 85C are registered serially with each other. The plunger 85B has an axial length set so that it is just accommodated in the plunger chamber 85A.

Meanwhile, a return spring 85E is provided adjacent an end of the guide plunger 85C for biasing the guide plunger 85C toward the plunger 85B. Accordingly, when the biasing force of the return spring 85E is exhibited effectively, the plunger 85B is resiliently pressed together with the guide plunger 85C so that it is accommodated into the plunger chamber 85A.

On the other hand, an oil passage 92 is formed at the end portion 84B of the rocker arm 84 and communicates with the plunger chamber 85A. The oil passage or operating liquid supply passage 92 communicates with another oil passage or operating liquid supply passage 90B formed in the rocker shaft 89 along its axis. Consequently, operating oil is supplied into the plunger chamber 85A by way of the oil passages 90B and 92.

When operating oil is supplied into the plunger chamber 85A, the plunger 85B is operated to project from the plunger chamber 85A against the biasing force of the return spring 85E so that the plunger 85B is fitted into the plunger chamber 85D of the main rocker arm 83. Consequently, the interconnecting mode in which the sub rocker arm 84 operates in an interlocking relationship with the main rocker arm 83 is realized.

On the contrary, when supply of operating oil into the plunger chamber 85A is interrupted, the plunger 85B is moved by the biasing force of the return spring 85E so that it is removed from the plunger chamber 85D of the main rocker arm 83 and accommodated into the plunger chamber 85A. Consequently, the non-interlocking mode wherein the sub rocker arm 84 does not operate in an interlocking relationship with the main rocker arm 83 is realized.

It is to be noted that supply of operating oil into the hydraulic lash adjuster 81 and the plunger chamber 85A is performed by respective operating oil supply systems (not shown). Each of the operating oil supply systems includes a hydraulic pump driven by the engine or a like element, and pressure regulating means for regulating the operating oil pressurized by the hydraulic pump to a required pressure to supply the operating oil into the oil passage 90A or 90B. It is to be noted that the oil passages 90A and 90B are worked simultaneously along the axis of the rocker shaft 89 and are partitioned from each other by a ball 93.

Each of the operating oil supply systems further includes a cut-off poppet valve which can change over between a supplying condition wherein operating oil of a pressure regulated by the pressure regulating means is supplied into the plunger chamber 85A by way of the oil passages 90B and 92 and another non-supplying condition wherein the operating oil is not supplied into the plunger chamber 85A. The cut-off popper valve may be constituted, for example, from a solenoid valve which can be electronically controlled by means of a controller (not shown). The sub rocker arm 84 can thus be changed over appropriately between the interlocking mode and the non-interlocking mode while the cut-off popper valve is controlled in response to the speed of rotation of the engine or some other parameter.

Also with the present valve operating system structure, in order to operate the valves 2 and 3 simultaneously at an accurate timing by means of the single swing arm 88, the clearances between the valve operating portions 88A of the swing arm 88 and the ends of the stems 6 of the valves 2 and 3 must necessarily be adjusted appropriately.

To this end, though not shown in the figures in which the valve operating system structure of the present embodiment is shown, for example, a shim 82 (refer to FIGS. 7 and 8) is mounted at the end of one or each of the stems 6 to effect adjustment of the clearance.

Since the valve operating system structure with a variable valve timing mechanism according to the second embodiment of the present invention is constructed in such a manner as described above, when the engine rotates at a low speed, operating oil in the plunger chamber 85A is discharged so that the plunger 85B is accommodated into the plunger chamber 85A.

Consequently, the non-interlocking mode in which the sub rocker arm 84 is pivotable relative to the rocker shaft 89 and does not operate in an interlocking relationship with the main rocker arm 83 is entered. Then, the main rocker arm 83 contacts with and is operated by the low speed cam 12 and accordingly is operated in accordance with the cam profile of the low speed cam 12 for a low speed valve timing. Consequently, the valves 2 and 3 are operated by way of the swing arm 88.

As a result, the valves 2 and 3 are operated at a valve timing suitable for low speed rotation and the engine operates efficiently.

On the other hand, when the engine rotates at a high speed, operating oil is supplied into the plunger chamber 85A by way of the oil supply system (not shown) so that the plunger 85B is fitted into the plunger chamber 85D of the main rocker arm 83.

Consequently, the interlocking mode wherein the sub rocker arm 84 operates in an interlocking relationship with the main rocker arm 83 is entered. Then, the main rocker arm 83 is operated in accordance with the cam profile of the high speed cam 13 for a high speed valve timing by way of the sub rocker arm 84 which contacts with and is operated by the high speed cam 13, and consequently, the valves 2 and 3 are operated by way of the swing arm 88.

As a result, the valves 2 and 3 are operated at a valve timing suitable for high speed rotation so that the engine operates efficiently.

When the present valve operating system operates, the hydraulic lash adjuster 81 interposed between the main rocker arm 83 and the swing arm 88 automatically adjusts the relative phase between the swing arm 88 and the main rocker arm 83, and consequently, the relative phase between the swing arm 88 and the main rocker arm 83 is maintained appropriately and the clearances between the main rocker arm 83 and the valves 2 and 3 by way of the swing arm 88 are always kept appropriately without requiring particular maintenance. Accordingly, the effects of vibrations and noise, which are liable to be produced by a valve operating system, are reduced and the reliability of the variable valve timing mechanism is enhanced.

Further, since, in the present embodiment, the hydraulic lash adjuster 81 is disposed adjacent the center of rocking motion of the main rocker arm 83, an increase of the valve side conversion weight of the valve operating system is suppressed and the acceleration and the centrifugal force acting upon the check valve ball 81H of the hydraulic adjuster 81 are suppressed so that the hydraulic lash adjuster 81 operates appropriately. Consequently, the variable valve timing mechanism operates appropriately.

Further, since the swing arm 88 is supported for pivotal motion on the rocker shaft 89, there are effects that the number of parts is decreased, that the structure is simplified and that the part cost and the assembly cost can be reduced. Further, the valve operating system can be constructed further compactly with a reduced weight, and an increase of the weight of the valve operating system can be suppressed and the operating characteristic of the valves can be enhanced. Consequently, there are an effect that the valve operating system can contribute to enhancement of the output performance of the engine and another effect that the degree of freedom in design is increased and the valve operating system can contribute also to enhancement of the durability.

Further, since the oil passage 90A for supplying operating oil into the hydraulic lash adjuster 81 therethrough is formed at the portion Of the rocker shaft 89 along its axis, provision of the oil passage 90A is easy and the structure is simplified, and operating oil can be supplied with certainty and the reliability of the hydraulic lash adjuster 81 is enhanced.

While the rocker arms 83 and 84 used in the present embodiment are of the slipper-shaped ones, they may otherwise be of the type with a rocker.

Figure 23:
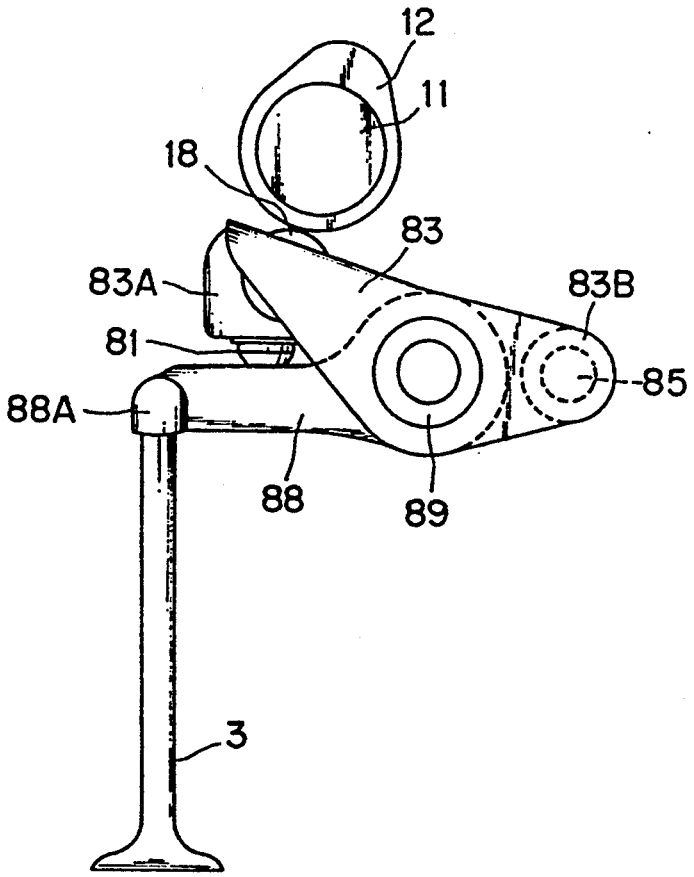
FIG. 23 is a schematic side elevational view similar to FIG. 18 but showing part of a modification to the valve operating system structure with a variable valve timing mechanism of FIG. 18.
Figure 24:
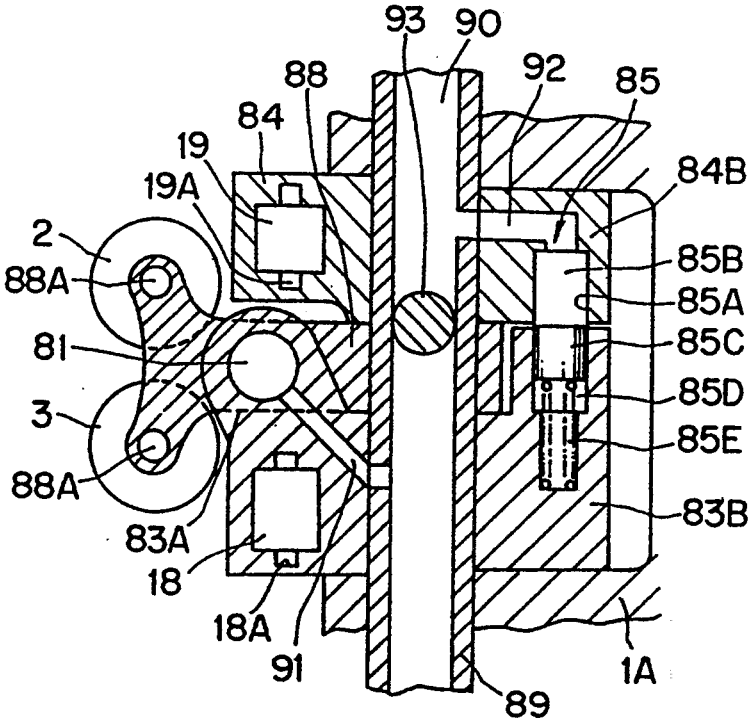
FIG. 24 is a schematic sectional view similar to FIG. 20 but showing mode change-over means mounted in the modified valve operating system structure with a variable valve timing mechanism shown in FIG. 23.
Figure 25:
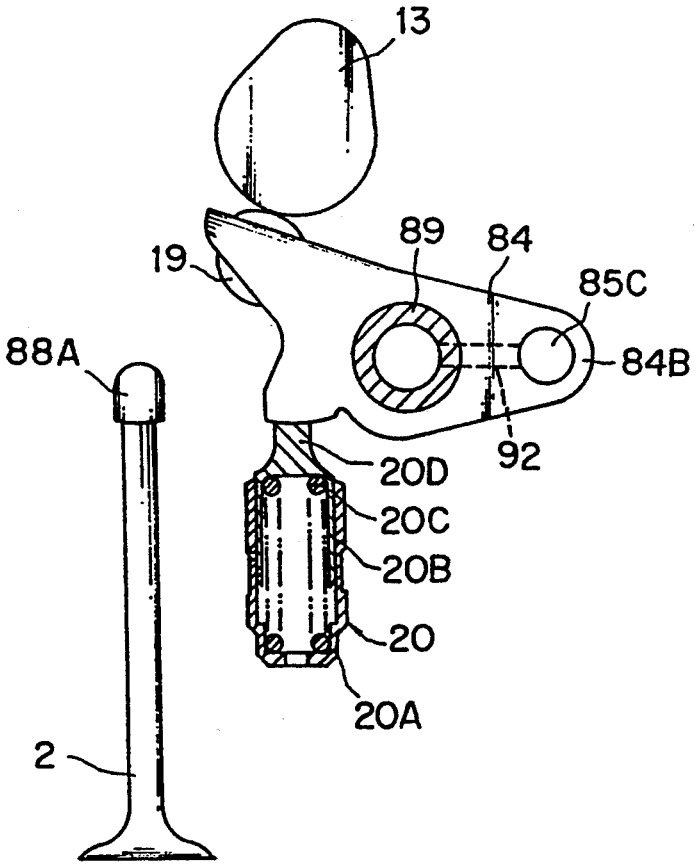
FIG. 25 is a sectional view similar to FIG. 22 but showing a sub rocker arm of the modified valve operating system structure with a variable valve timing mechanism shown in FIG. 23.

FIGS. 23 to 25 show a modified valve operating system which includes such rocker arms 83 and 84 of the type provided with a roller. Referring to FIGS. 23 to 25, the low speed roller 18 for contacting with the low speed cam 12 and the high speed roller 19 for contacting with the high speed cam 13 are provided at contacting portions of the rocker arms 83 and 84 at which the rocker arms 83 and 84 contact with the cams 12 and 13, respectively. The low speed roller 18 is supported for smooth rotation by means of the roller bearing (not shown) on the shaft 18A provided on the main rocker arm 83, and the high speed roller 19 is supported for smooth rotation by way of the roller bearing (not shown) on the shaft 19A provided on the sub rocker arm 84.

The low speed roller 18 may be made of a material lighter in weight than that of the high speed roller 19 similarly as in the first embodiment. For example, while the high speed roller 19 is made of a popular metal material of the iron type, the low speed roller 18 is made of a material having a lighter weight and a predetermined abrasion resistance such as a ceramic material.

The present valve operating system is constructed in a similar manner as the valve operating system of the second embodiment except the elements described above.

Due to the construction described above, the modified valve operating system exhibits, in addition to action and effects similar to those of the second embodiment, an effect that, since the rocker arms 83 and 84 contact with the low speed cam and the high speed cam by way of the rollers 18 and 19, respectively, abrasion of the contacting portions of the rocker arms 83 and 84 with the cams is suppressed and consequently the valve operating system can maintain a required performance for a long period of time.

Subsequently, a further valve operating system with a variable valve timing mechanism according to a third preferred embodiment of the present invention which is characterized in valve contacting portions of a main rocker arm and a sub rocker arm and contacting portions of valves will be described.

The valve operating system of the present embodiment has a structure wherein it includes a pair of intake or exhaust valves and a plurality of valves 2 and 3 are operated simultaneously by way of a single swing arm 180. The general construction of the valve operating system of the present invention is similar to that of the first modification to the valve operating system of the first embodiment shown in FIGS. 5 to 8. Therefore, detailed description of such common features is omitted herein to avoid redundancy.

In order to operate the valves 2 and 3 simultaneously at an accurate timing by way of the single swing arm 180, the clearances between valve contacting portions 180C of the swing arm 180 and the ends of the stems 6 of the valves 2 and 3 must necessarily be adjusted appropriately.

Figure 26A:
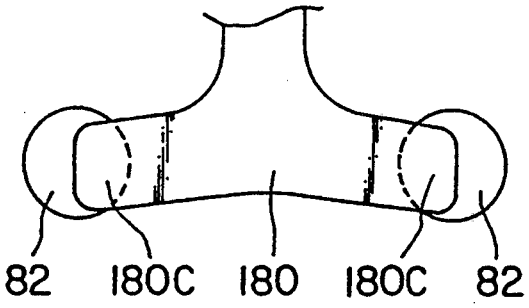
FIGS. 26(A) and 26(B) are a plan view and a front elevational view, respectively, showing an arrangement of part of a further valve operating system structure with a variable valve timing mechanism according to a third preferred embodiment of the present invention.
Figure 26C:
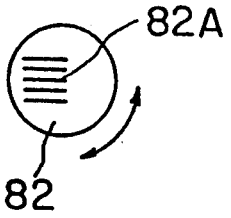
FIG. 26(C) is a schematic sectional view showing contacting portions (interposed members) for contacting with valves in the valve operating system structure with a variable valve timing mechanism.
Figure 26B:
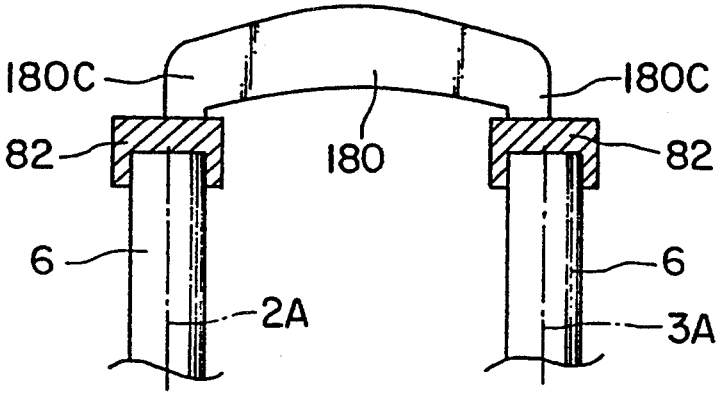

To this end, a shim 82 serving as an interposed member is mounted at the end of the valve stem 6 of one or each of the valves 2 and 3 as shown in FIGS. 26(A) and 26(B) to effect adjustment of the clearance or clearances. In short, clearance adjustment is performed by mounting a shim 82 of a suitable thickness in accordance with the clearance condition.

Further, in the present structure, contacting points or portions 82A of the valves 2 and 3, that is, the shims 82, with the valve contacting portions 180C are located at positions displaced from the axial lines of the valves 2 and 3 as seen from FIG. 26(C). Particularly, in the present embodiment, the two contacting centers 82A are provided at positions displaced toward the inner side from the axes of the valves 2 and 3.

Since the valve operating system with a variable valve timing mechanism of the third embodiment has such a construction as described above, the following effects are obtained.

Figure 28A:
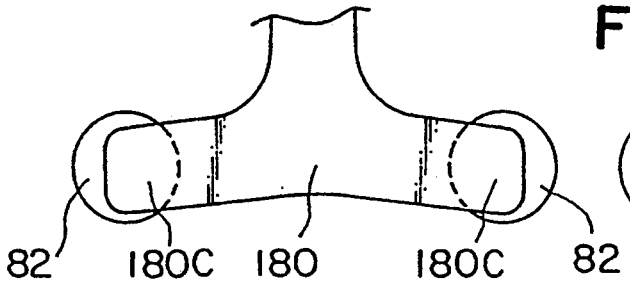
FIGS. 28(A) and 28(B) are a plan view and a front elevational view, respectively, showing an alternative arrangement for comparison with the valve operating system structure with a variable valve timing mechanism shown in FIGS. 26(A) to 26(C)
Figure 28C:
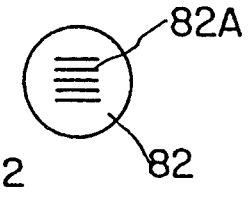
FIG. 28(C) is a schematic sectional view showing contacting portions (interposed members) for contacting with valves in the valve operating system structure with a variable valve timing mechanism.
Figure 28B:
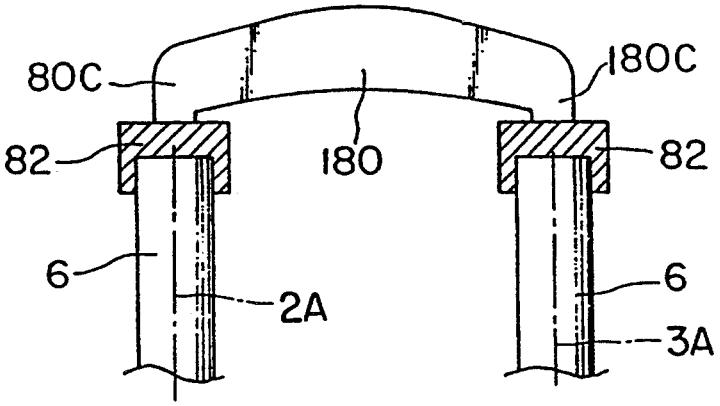

In particular, where the contacting points or portions 82A at which the valve contacting portions 180C contact with the valves 2 and 3, that is, the shims 82, are alternatively provided on the axial lines of the valves 2 and 3 as seen from FIGS. 28(A) to 28(C), since the contacting points are fixed, one-sided abrasion takes place with the contacting portions.

In contrast, with the present structure, since the contacting points OF portions 82A at which the valve contacting portions 180C contact with the valves 2 and 3, that is, the shims 82, are located at displaced positions as seen from FIGS. 26(A) to 26(C), as the valves are operated, the contacting points between the valves and the valve contacting portions rotate relatively around the axial lines of the valves and suitable oil films are formed between the contacting portions so that one-sided abrasion of the contacting portions is prevented.

Consequently, there is a significant advantage that the durability of the valve operating system is enhanced significantly.

Particularly, in the present embodiment, since the two contacting centers 82A are located at positions displaced toward each other from the axes of the valves 2 and 3, the bifurcated portion Of the swing arm 180 at which the valve contacting portions 180C are provided can be reduced in size, and the valve operating system can be reduced in weight. Consequently, enhancement of the high speed performance of the valve operating system as well as reduction of the overall weight of the engine can be achieved.

Figure 27A:
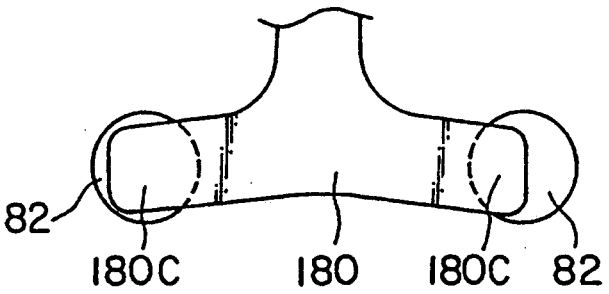
FIGS. 27(A) and 27(B) are a plan view and a front elevational view, respectively, showing an arrangement of part of a modification to the valve operating system structure with a variable valve timing mechanism shown in FIGS. 26(A) to 26(C)
Figure 27C:
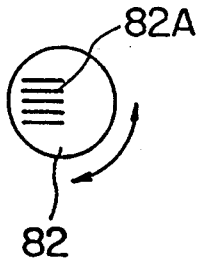
FIG. 27(C) is a schematic sectional view showing contacting portions (interposed members) for contacting with valves in the valve operating system structure with a variable valve timing mechanism.
Figure 27B:
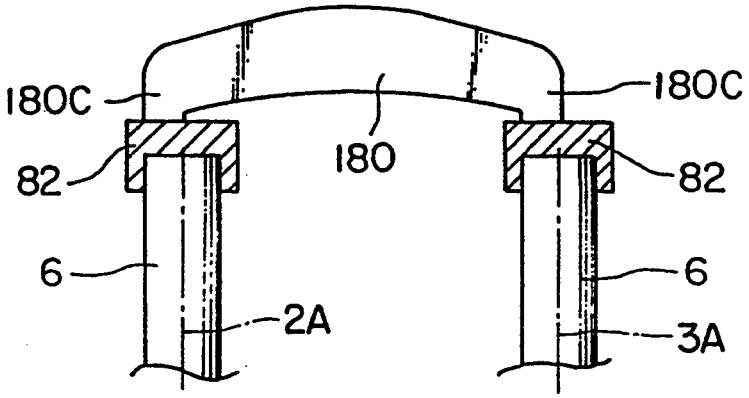

It is to be noted that the displacement of the contacting centers 82A is not limited to that shown in FIGS. 26(A) to 26(C), but a swing arm 180 of the conventional shape may be displaced as it is from the valves 2 and 3 as seen from FIGS. 27(A) to 27(C). In the arrangement shown in FIGS. 27(A) to 27(C), at the head of the valve 2, the valve contacting portion 180C is located at a position displaced outwardly from the axis of the valve 2, but at the head of the valve 3, the contacting center 82A is located at another position displaced inwardly from the axis of the valve 3. Naturally, the displacement may be reverse such that, at the head of the valve 2, the contacting center 82A is located at a position displaced inwardly from the axis of the valve 2, but at the head of the other valve 3, the contacting center 82A is located at another position displaced outwardly from the axis of the valve 3. Or else, both of the contacting centers 82A may be displaced outwardly from the axes of the valves 2 and 3.

It is to be noted that the displacement structure of the contacting portions in the valve operating system structure of the present embodiment is not limited to that described above and, for example, it can be applied to such a valve operating system of the type as in the second embodiment or it can be applied to such a valve operating system of the single valve type as in the first embodiment. Further, the displacement structure of the contacting portions is not limited to that of the structure which includes a swing arm supported from pivotal motion and for adjustment in phase relative to a rocker arm as in the embodiments described hereinabove, but can be applied to a rocker arm side end portion of a valve operating system of the type wherein such a swing arm as described above is not provided and a rocker arm contacts directly with a valve.

It is to be noted that, while, in the embodiments and modifications described above, the low speed roller 18 is made of a material lighten in weight than that of the high speed roller 19, this feature may not always be employed. Naturally, a rocker arm having no roller may be employed as in the second embodiment. Further, the location of the operating liquid supply passage is not limited to the portion of the main rocker arm along the axis of rocking motion.

What is claimed is:

1. A valve operating system structure with a variable valve timing mechanism, comprising:

an intake valve or an exhaust valve provided for an engine;

a low speed cam having a cam profile for a low speed valve timing and rotatable in response to rotation of a crankshaft of said engine;

a high speed cam having a cam profile for a high speed valve timing and rotatable in response to rotation of said crankshaft;

a main rocker arm for contacting with said low speed cam so as to be operated by said low speed cam;

a sub rocker arm for contacting with said high speed cam so as to be operated by said high speed cam;

mode change-over means for changing over the mode of said sub rocker arm between a non-interlocking mode in which said sub rocker arm is not interlocked with said main rocker arm and an interlocking mode in which said sub rocker arm is interlocked with said main rocker arm;

a swing arm supported for pivotal motion and for adjustment in phase relative to said main rocker arm and having a valve contacting portion for contacting with said valve to drive said valve: and a hydraulic lash adjuster for adjusting the relative phase between said main rocker arm and said swing arm.

2. A valve operating system structure with a variable valve timing mechanism as claimed in claim 1, wherein said hydraulic lash adjuster is disposed at a location nearer to the center of rocking motion of said main rocker arm than said valve contacting portion of said swing arm.

3. A valve operating system structure with a variable valve timing mechanism as claimed in claim 1, wherein said hydraulic lash adjuster is disposed such that it projects from an upper face of said main rocker arm.

4. A valve operating system structure with a variable valve timing mechanism as claimed in claim 1, wherein said swing arm is disposed such that the center of rocking motion thereof is displaced toward said valve contacting portion thereof from the center of rocking motion of said main rocker arm, and said hydraulic lash adjuster is disposed adjacent the center of rocking motion of said main rocker arm with respect to the center of rocking motion of said swing arm while said valve contacting portion of said swing arm is disposed on the opposite side to said hydraulic lash adjuster with respect to the center of rocking motion of said swing arm.

5. A valve operating system structure with a variable valve timing mechanism as claimed in claim 1, wherein said main rocker arm has a low speed roller provided thereon for contacting with said low speed cam while said sub rocker arm has a high speed roller provided thereon for contacting with said high speed cam.

6. A valve operating system structure with a variable valve timing mechanism as claimed in claim 1, wherein said hydraulic lash adjuster is disposed at or around the center of rocking motion of said main rocker arm.

7. A valve operating system structure with a variable valve timing mechanism as claimed in claim 1, wherein said main rocker arm is supported on a rocker shaft and an operating liquid supply passage for supplying operating liquid to said hydraulic lash adjuster is formed through said rocker shaft.

8. A valve operating system structure with a variable valve timing mechanism as claimed in claim 1, wherein said mode change-over means includes a hydraulic piston mechanism movable between a position in which said sub rocker arm is operatively independent of said main rocker arm and another position in which said sub rocker arm is capable of being interlocked with said main rocker arm, and said hydraulic piston mechanism is disposed on a rocker shaft on which said main rocker arm is supported for pivotal motion.

9. A valve operating system structure with a variable valve timing mechanism as claimed in claim 1, wherein said swing arm and said hydraulic lash adjuster are disposed between said main rocker arm and said sub rocker arm.

10. A valve operating system structure with a variable valve timing mechanism as claimed in claim 1, wherein said main rocker arm has a low speed roller provided thereon for contacting with said low speed cam while said sub rocker arm has a high speed roller provided thereon for contacting with said high speed cam, and said low speed roller and said swing arm are supported in a coaxial relationship with each other.

11. A valve operating system structure with a variable valve timing mechanism as claimed in claim 1, wherein said main rocker arm is supported on a rocker shaft in which an operating liquid supply passage for supplying operating liquid to said hydraulic lash adjuster is formed, and the distance from the center of rocking motion of said main rocker arm to said hydraulic lash adjuster is set smaller than the sum of the radius of said operating liquid supply passage and the radius of said hydraulic lash adjuster.

12. A valve operating system structure with a variable valve timing mechanism as claimed in claim 1, wherein said swing arm is disposed such that the center of rocking motion thereof is displaced toward said valve contacting portion thereof from the center of rocking motion of said main rocker arm, and said hydraulic lash adjuster is disposed at an end portion of said main rocker arm adjacent the center of rocking motion of said main rocker arm with respect to the center of rocking motion of said swing arm while said valve contacting portion of said swing arm is disposed at the opposite end of said main rocker arm to said hydraulic lash adjuster with respect to the center of rocking motion of said swing arm such that the distance from said hydraulic lash adjuster to the center of rocking motion of said swing arm is set greater than the distance from said valve contacting portion of said swing arm to the center of rocking motion of said swing arm.

13. A valve operating system structure with a variable valve timing mechanism as claimed in claim 1, wherein the center of contact of said valve contacting portion of said swing arm with said valve is located at a position displaced from the axis of said valve.

14. A valve operating system structure with a variable valve timing mechanism as claimed in claim 13, wherein said valve comprises a pair of valves and said swing arm is bifurcated into a pair of branches each having a valve contacting portion at an end thereof, and the centers of contact of the valve contacting portions with the valves are located at positions displaced from the axes of said valves.

15. A valve operating system structure with a variable valve timing mechanism as claimed in claim 14, wherein the centers of contact of said valve contacting portions with said valves are located at positions displaced inwardly toward each other with respect to the axes of said valves.

16. A valve operating system structure with a variable valve timing mechanism as claimed in claim 13, wherein an interposed member is interposed between said valve contacting portion of said swing arm and said valve.

17. A valve operating system structure with a variable valve timing mechanism, comprising:

an intake valve OF an exhaust valve provided for an engine;

a low speed cam having a cam profile for a low speed valve timing and rotatable in response to rotation of a crankshaft of said engine;

a high speed cam having a cam profile for a high speed valve timing and rotatable in response to notation of said crankshaft;

a main rocker arm for contacting with said low speed cam so as to be operated by said low speed cam to operate said valve;

a sub rocker arm for contacting with said high speed cam so as to be operated by said high speed cam; and mode change-oven means foe changing even the mode of said sub rocker arm between a non-interlocking mode in which said sub rocker arm is not interlocked with said main rocker arm and an interlocking mode in which said sub rocker arm is interlocked with said main rocker arm;

said main rocker arm having a valve contacting portion for contacting with said valve to drive said valve;

the center of contact of said valve contacting portion of said main rocker arm being located at a position displaced from the axis of said valve.

18. A valve operating system structure with a variable valve timing mechanism as claimed in claim 17, wherein said valve comprises a pair of valves and said main rocker arm is bifurcated into a pair Of branches each having a valve contacting portion at an end thereof, and the centers of contact of the valve contacting portions with the valves are located at positions displaced from the axes of said valves.

19. A valve operating system structure with a variable valve timing mechanism as claimed in claim 18, wherein the centers of contact of said valve contacting portions with said valves are located at positions displaced inwardly toward each other with respect to the axes of said valves.

20. A valve operating system structure with a variable valve timing mechanism as claimed in claim 17, wherein an interposed member is interposed between said valve contacting portion of said main rocker arm and the corresponding valve.

* * * * *